US008686925B2

(12) United States Patent
Chung et al.

(10) Patent No.: US 8,686,925 B2
(45) Date of Patent: Apr. 1, 2014

(54) ORGANIC LIGHT EMITTING DIODE DISPLAY DEVICE AND DRIVING METHOD THEREOF

(75) Inventors: Injae Chung, Gyeonggi-do (KR); Kiyong Kim, Gyeonggi-do (KR); Chulsang Jang, Gyeonggi-do (KR); Insu Joo, Gyeonggi-do (KR); Woojin Nam, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1263 days.

(21) Appl. No.: 12/149,830

(22) Filed: May 8, 2008

(65) Prior Publication Data

US 2008/0284691 A1 Nov. 20, 2008

(30) Foreign Application Priority Data

May 9, 2007 (KR) ..... 10-2007-0044821

(51) Int. Cl.
*G09G 3/30* (2006.01)

(52) U.S. Cl.
USPC ..... 345/76

(58) Field of Classification Search
USPC ..... 345/75–82
See application file for complete search history.

(56) References Cited

U.S. PATENT DOCUMENTS

2005/0052366 A1* 3/2005 Kim ..... 345/76
2005/0259703 A1 11/2005 You et al.

FOREIGN PATENT DOCUMENTS

KR 2005-0110823 A 11/2005
KR 2006-0134405 A 12/2006

OTHER PUBLICATIONS

KIPO: Office Action for Korean Patent Application No. 10-2007-0044821—Issued on May 21, 2013.

* cited by examiner

*Primary Examiner* — Dennis Joseph
(74) *Attorney, Agent, or Firm* — Morgan, Lewis & Bockius LLP

(57) ABSTRACT

An organic light emitting diode display device and a driving method thereof are disclosed. The organic light emitting diode display device according to an embodiment of the invention comprises a display panel including a plurality of data lines, a plurality of gate line pairs crossing the data lines, and a plurality of light emitting cells which include an organic light emitting diode device, first and second cell driving circuits for alternately driving the organic light emitting diode device; a data voltage generator supplying a data voltage of a first polarity to the data lines; a compensation voltage generator supplying a compensation voltage of a second polarity to the data lines; and a scan driver for sequentially supplying scan pulses to the gate line pairs, wherein the first and second cell driving circuits are alternately supplied with the data voltage and the compensation voltage in response to the scan pulses to alternately driven the organic light.

8 Claims, 33 Drawing Sheets

Fig. 19

| Vdata | Δth after N frames | x |
|---|---|---|
| 0 | 0 | 0 |
| 1 | 0.10 | 0.1 |
| 2 | 0.17 | 0.085 |
| 3 | 0.20 | 0.067 |
| 4 | 0.25 | 0.063 |
| 5 | 0.30 | 0.06 |

| Vndi | Δth after N frames | y |
|---|---|---|
| 0 | 0 | 0 |
| −1 | −0.08 | 0.08 |
| −2 | −0.13 | 0.065 |
| −3 | −0.17 | 0.056 |
| −4 | −0.20 | 0.05 |
| −5 | −0.24 | 0.048 |

Fig. 20

| Vndi | Δth after 50 frames | x |
|---|---|---|
| 0 | 0 | 0 |
| −1 | −0.08 | 0.08 |
| −2 | −0.13 | 0.065 |
| −3 | −0.17 | 0.056 |
| −4 | −0.20 | 0.05 |
| −5 | −0.24 | 0.048 |

⇨

| Vndi | Δth after 100 frames | y |
|---|---|---|
| 0 | 0 | 0 |
| −1 | −0.16 | 0.08 |
| −2 | −0.26 | 0.065 |
| −3 | −0.34 | 0.056 |
| −4 | −0.40 | 0.05 |
| −5 | −0.48 | 0.048 |

ORGANIC LIGHT EMITTING DIODE DISPLAY DEVICE AND DRIVING METHOD THEREOF

This non-provisional application claims priority under 35 U.S.C. §119(a) on Korean Patent Application No. 10-2007-0044821 filed in the Republic of Korea on May 9, 2007, the entire contents of which are hereby incorporated by reference in their entirety.

BACKGROUND OF THE INVENTION

1. Field of the Invention

The embodiments of the invention relate to a display device, and more particularly, to an organic light emitting diode display device and a driving method thereof. Although embodiments of the invention are suitable for a wide scope of applications, it is particularly suitable for compensating the variation in threshold voltage of a thin film transistor caused by gate bias stress.

2. Discussion of the Related Art

Recently, flat display panels with reduced weight and size have been developed to replace the cathode ray tube display device, which is heavy and bulky. Such flat panel display devices include a liquid crystal display (hereinafter, referred to as "LCD") device, a field emission display (hereinafter, referred to as "FED") device, a plasma display panel (hereinafter, referred to as "PDP") device, and an electro-luminescence (hereinafter, referred to as "EL") display device. A PDP has light weight, thin profile, simple structure and is easy to manufacture. However, a PDP has low light-emission efficiency and requires large power consumption. The LCD device employs a thin film transistor ("TFT") as a switching device. The TFT LCD device has the problems of narrow viewing angle and low response speed due to the required need of switching liquid crystal molecules to control light from a backlight. An EL display device is generally classified as either an inorganic EL display device or an organic light-emitting diode display device depending upon the material of a light-emitting layer. An EL display device is self-luminous. When compared with the above-mentioned display devices, the EL device generally has faster response speed, higher light-emission efficiency, greater brightness and wider viewing angle.

An organic light emitting diode device, as illustrated in FIG. 1, includes a hole injection layer HIL, a hole transport layer HTL, an emission layer EML, an electron transport layer ETL, and an electron injection layer EIL formed between an anode electrode and a cathode electrode. When a driving voltage is applied across the anode electrode and the cathode electrode, a hole within the hole injection layer and an electron within the electron injection layer respectively move toward the emission layer EML to form excitons. As a result of exciton generation, the emission layer EML emits visible rays.

A plurality of the organic light emitting diode display devices shown in FIG. 1 can be arranged in a matrix array. By selecting each of the organic light emitting diode devices with a scan voltage for driving by a data voltage, the brightness of the matrix array of organic light emitting diode devices can be controlled in accordance with digital video data. The above-described matrix array of organic light-emitting diode display devices is classified as either a passive matrix type display device or an active matrix type display, which uses a TFT as a switching element. In the active matrix type, an organic light emitting diode device is selected by using a TFT, which is an active device, such that the organic light emitting diode device is driven.

FIG. 2 is a circuit diagram equivalently showing one pixel in an organic light-emitting diode display device of an active matrix type. As shown in FIG. 2, the organic light-emitting diode display device of the active matrix type includes an organic light-emitting diode element OLED, a data line DL and a gate line GL that cross each other, a switch TFT ST, a driving TFT DRT and a storage capacitor. The driving TFT ST and the switch TFT DRT are implemented as N-type metal-oxide-semiconductor field-effect transistors ("MOSFETs').

The switch TFT SWT turns on in response to scan pulses from the gate line GL to electrically connect a current path between a source electrode and a drain electrode of the switch TFT SWT. A positive data voltage from the data line DL is applied, via the source electrode and the drain electrode of the switch TFT SWT, to a gate electrode and a storage capacitor of the driving TFT DRT during an on-time period of the switch TFT SWT. The driving TFT DRT supplies current to the organic light emitting diode OLED in accordance with a gate voltage supplied to its gate electrode, i.e., a positive data voltage, to drive the organic light emitting diode OLED. The storage capacitor stores a difference voltage between the positive data voltage and a low-level power supply voltage VSS, which constantly maintains a voltage applied to the gate electrode of the driving TFT DRT during one frame period. The organic light-emitting diode display OLED has the structure shown in FIG. 1.

The brightness of a cell, as shown in FIG. 2, is proportional to current flowing through the organic light emitting diode OLED, and the current is adjusted by a gate voltage of the driving TFT DRT. The current IOLED of the organic light emitting diode OLED flowing through the driving TFT DRT is defined by the following Equation (1).

$$I_{OLED} = \frac{\beta}{2}(Vgs - |Vth|)^2 = \frac{k}{2}\frac{W}{L}(Vdata - VSS - |Vth|)^2 \quad (1)$$

wherein, 'Vth' represents a threshold voltage of the driving TFT DRT, 'k' represents a constant defined by mobility and a parasitic capacitance of the driving TFT DRT, 'L' represents a channel length of the driving TFT DRT and 'W' represents a channel width of the driving TFT DRT, respectively.

As shown in Equation 1, the current IOLED of the organic light emitting diode OLED varies in accordance with the threshold voltage Vth or mobility of the driving TFT DRT. Therefore, to ensure uniform picture quality of displayed images on the organic light emitting diode display device, all of the driving TFTs DRT of the entire display device are required to have uniform electrical characteristics. However, the threshold voltage Vth of the driving TFT DRT varies due to a gate bias stress, and as a result, degradation of current flowing through the organic light emitting diode OLED increases with time, thereby lowering the reliability of driving.

FIGS. 3 and 4 are graphs showing examples of variations in the threshold voltage of a thin film transistor caused by gate bias stress. Gate bias stress is the phenomenon in which the threshold voltage Vth of a TFT is shifted when the gate voltage of the TFT is a continuously applied positive voltage (positive gate bias stress), as illustrated in FIG. 3, or a continuously applied negative voltage (negative gate bias stress), as illustrated in FIG. 4. In FIGS. 3 and 4, the horizontal axis represents the gate voltage Vg applied to the gate electrode of the TFT, while the longitudinal axis represents drain-source current Ids of the TFT. The threshold voltage of the TFT becomes higher due to the positive gate bias stress of FIG. 3, and the threshold voltage of the TFT becomes lower due to the negative gate bias stress of FIG. 4. Such a gate bias stress is caused by charge trapping in which ions are caught in the insulating layer between the electrodes of the TFT. The trapping creates a defect in that the threshold voltage of the TFT shifts such that mobility in the channel layer is changed.

To compensate for threshold voltage shift of the driving TFT DRT in each of circuits of light emitting cells of the organic light emitting diode display device as illustrated in FIG. 2, a BDI (black data insertion) driving method has been proposed in which both a negative compensation voltage and a positive data voltage are applied to the gate electrode of the driving TFT DRT within 1 frame period.

FIG. 5 shows a driving waveform of the related art BDI driving method. As shown in FIG. 5, in the BDI driving method, 1 frame period is time-divided into an emission period (on) and a non-emission period (off) for driving the light emitting cells. In the related art BDI driving method, as shown in FIG. 5, as the emission-on period ends with an emission-off period within 1 frame period, the data voltage is turned off so the effect of reduction of gate bias stress is low when a negative compensation voltage is applied.

SUMMARY OF THE INVENTION

Accordingly, embodiments of the invention are directed to an organic light emitting diode display device and a driving method thereof that substantially obviates one or more of the problems due to limitations and disadvantages of the related art.

An object of embodiments of the invention is to compensate for the variation in threshold voltage of a TFT caused by gate bias stress.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the organic light emitting diode display device according to an embodiment of the invention comprises a display panel including a plurality of data lines, a plurality of gate line pairs crossing the data lines, and a plurality of light emitting cells which include an organic light emitting diode device, first and second cell driving circuits for alternately driving the organic light emitting diode device; a data voltage generator supplying a data voltage of a first polarity to the data lines; a compensation voltage generator supplying a compensation voltage of a second polarity to the data lines; and a scan driver for sequentially supplying scan pulses to the gate line pairs, wherein the first and second cell driving circuits are alternately supplied with the data voltage and the compensation voltage in response to the scan pulses to alternately driven the organic light emitting diode.

In another aspect, the driving method of the organic light emitting diode display device comprises supplying a data voltage of a first polarity to the data lines; supplying a compensation voltage of a second polarity to the data lines; sequentially supplying scan pulses to the gate line pairs; and alternately supplying the data voltage and the compensation voltage to the first and second driving circuits in accordance with the scan pulses to drive the organic light emitting diode.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 19 shows an example of a look-up table in which positive data voltages and negative compensation voltages are listed;

FIG. 20 is a view showing a change in the look-up table depending on a change in the number of frames;

DETAILED DESCRIPTION OF THE PREFERRED EMBODIMENTS

Figure 1:
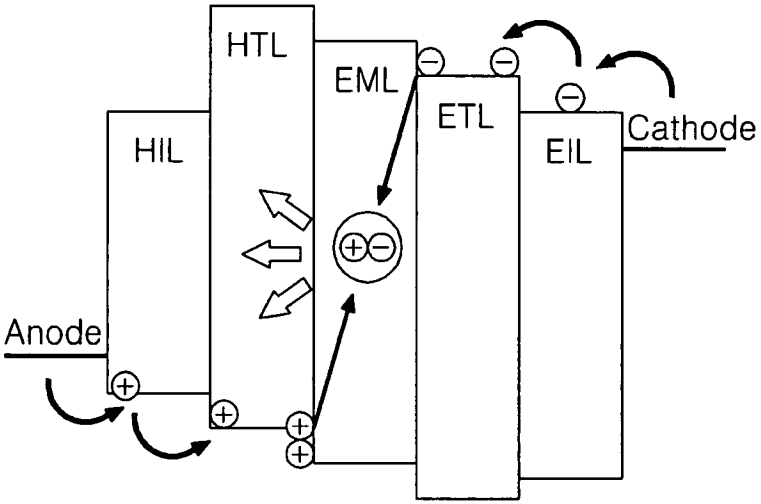
Fig. 1 [Related Art]
FIG. 1 is view schematically showing the structure of an organic light emitting diode display device.
Figure 2:
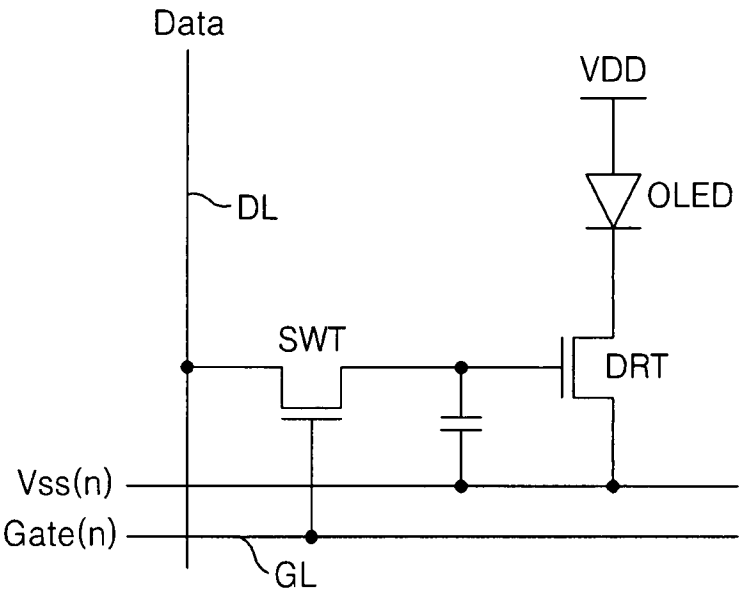
Fig. 2 [Related Art]
FIG. 2 is a circuit diagram equivalent showing one pixel in an organic light-emitting diode display device of an active matrix type.
Figure 3:
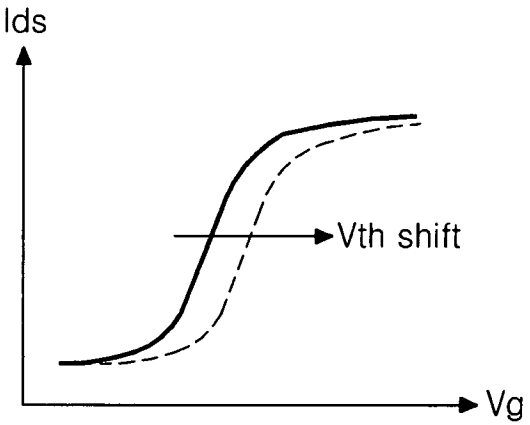
Fig. 3 [Related Art]
FIGS. 3 and 4 are graphs showing examples of variations in the threshold voltage of a thin film transistor caused by gate bias stress.
Figure 4:
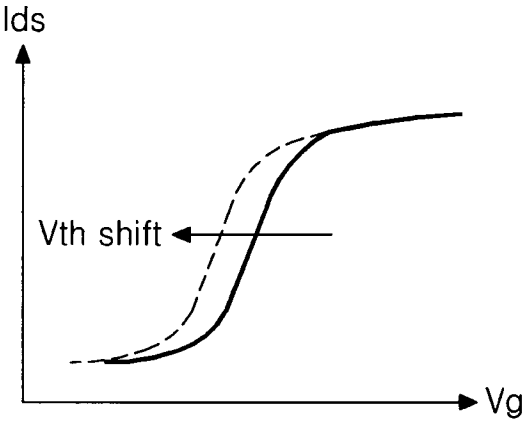
Fig. 4 [Related Art]
Figure 5:
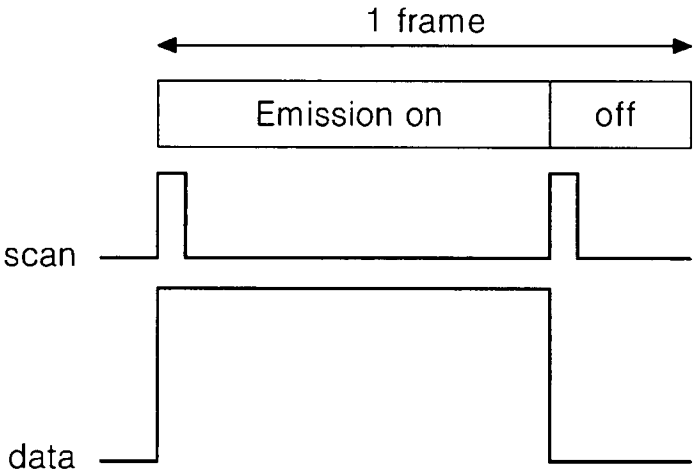
Fig. 5 [Related Art]
FIG. 5 shows a driving waveform of the related art BDI driving method.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 6:
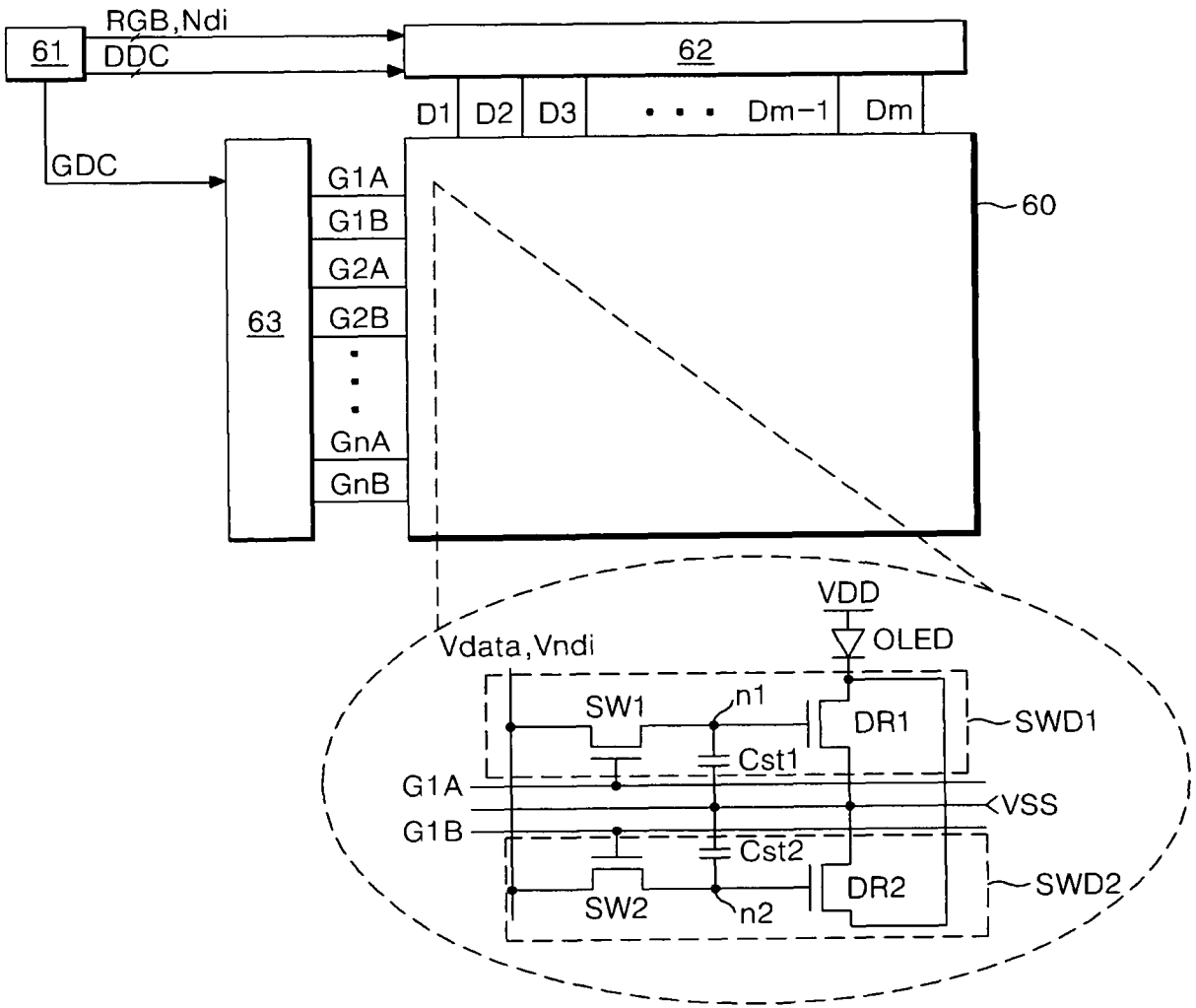
FIG. 6 is a block diagram showing an organic light emitting diode display device according to a first embodiment of the invention.

FIG. 6 is a block diagram showing an organic light emitting diode display device according to a first embodiment of the invention. Referring to FIG. 6, the organic light-emitting diode display device according to the first embodiment of the invention includes a display panel 60 provided with an m×n number of light emitting cells, a data driver 62 for converting digital video data RGB and digital compensation data Ndi into analog voltages and supplying the analog voltages to data lines D1 to Dm, a scan driver 63 for sequentially supplying scan pulses to gate lines G1A to GnB, and a timing controller 61 for controlling the drivers 62 and 63. In the display panel 60, light emitting cells are formed in light emitting cell areas defined by a crossing gate lines G1A to GnB and data lines D1 to Dm. A high-level power supply voltage VDD and a low-level power supply voltage VSS are supplied to each of the light emitting cells of the display panel 60. The gate lines are paired for each pixel row. The gate line pairs G1A and G1B, G2A and G2Bm, . . . , GnA and GnB include two gate lines to which scan pulses are sequentially inputted. Each of the light emitting cells is provided with first and second cell driving circuits SWD1 and SWD2 for alternately driving the organic light emitting diode OLED. The organic light emitting diode OLED has an anode electrode to which a high-level power voltage VDD is supplied and a cathode electrode connected to the drain electrode of a first driving TFT DR1, with an organic compound layer, as shown in FIG. 1, formed between the electrodes.

The first cell driving circuit SWD1 includes a first switching TFT SW1, a first storage capacitor Cst1, and a first driving TFT DR1. The first cell driving circuit SWD1 drives the organic light emitting diode OLED during an emission period, and recovers the variation of the threshold voltage of the first driving TFT DR1 during a non-emission period. The first switch TFT SW1 supplies a positive data voltage Vdata from the data lines D1 to Dm to a gate electrode of the first driving TFT DR1 and the first storage capacitor Cst1 during the emission period, and supplies a negative compensation voltage Vndi from the data lines D1 to Dm to the gate electrode of the first driving TFT DR1 and the first storage capacitor Cst1 during the non-emission period. A drain electrode of the first switching TFT SW1 is connected to the data lines D1 to Dm, and a source electrode thereof is connected to the gate electrode of the first driving TFT DR1 and the first storage capacitor Cst1 via a first node n1. A gate electrode of the first switching TFT is connected to the first gate lines G1A, G2A, . . . , GnA.

The first storage capacitor Cst1 stores a difference voltage between the low-level power supply voltage VSS and a gate voltage of the first driving TFT DR1, which constantly maintains the gate voltage of the first driving TFT DR1. One electrode of the first storage capacitor Cst1 is connected to the gate electrode of the first driving TFT DR1 and a source electrode of the first switching TFT SW1 via the first node n1. The other electrode of the first storage capacitor Cst1 is connected to a power line supplying a low-level power supply voltage VSS.

The first driving TFT DR1 is driven by a positive data voltage input via the first switching TFT SW1 during an emission period to make current flow through the organic light emitting diode OLED. The threshold voltage of the first driving TFT DR1 may be shifted by the positive data voltage Vdata supplied during the emission period. During the non-emission period, a negative compensation voltage Vndi supplied to the first driving TFT DR1 to recover the variation of the threshold voltage of the first driving TFT DR1 varied by the positive data voltage Vdata back to the original state. A drain electrode of the first driving TFT DR1 is connected to the cathode electrode of the organic light emitting diode OLED, and a source electrode thereof is connected to a power line supplying a low-level power supply voltage VSS. The gate electrode of the first driving TFT DR1 is connected to the source electrode of the first switching TFT SW1 and one electrode of the first storage capacitor Cst via the first node n1.

The second cell driving circuit SWD2 includes a second switching TFT SW2, a second storage capacitor Cst2, and a second driving TFT DR2. The second cell driving circuit SWD2 drives the organic light emitting diode OLED during an emission period, and recovers the variation of the threshold voltage of the second driving TFT DR2 during a non-emission period. The non-emission period of the first cell driving circuit SWD1 and the non-emission period of the second cell driving circuit SWD2 do not overlap with each other, and the emission period of the first cell driving circuit SWD1 and the non-emission period of the second cell driving circuit SWD2 do not overlap with each other. The first cell driving circuit SWD1 and the second cell driving circuit SWD2 are alternately operated to drive the organic light emitting diode OLED. Therefore, the organic light emitting diode OLED can continuously emit light without any non-emission period by the first and second cell driving circuits SWD1 and SWD2.

The second switching TFT SW2 supplies a positive data voltage Vdata from the data lines D1 to Dm to a gate electrode of the second driving TFT DR2 and the second storage capacitor Cst2 during the emission period, and supplies a negative compensation voltage Vndi from the data lines D1 to Dm to the gate electrode of the second driving TFT DR2 and the second storage capacitor Cst2 during the non-emission period. A drain electrode of the second switching TFT SW2 is connected to the data lines D1 to Dm, and a source electrode thereof is connected to the gate electrode of the second driving TFT DR2 and the second storage capacitor Cst2 via a second node n2. A gate electrode of the second switching TFT is connected to the second gate lines G1B, G2B, . . . , GnB.

The second storage capacitor Cst2 stores a difference voltage between the low-level power supply voltage VSS and a gate voltage of the second driving TFT DR2, which constantly maintains the gate voltage of the second driving TFT DR2. One electrode of the second storage capacitor Cst2 is connected to the gate electrode of the second driving TFT DR2 and a source electrode of the second switching TFT SW2 via the second node n2. The other electrode of the second storage capacitor Cst2 is connected to a power line supplying a low-level power supply voltage VSS.

The second driving TFT DR2 is driven by a positive data voltage input via the second switching TFT SW2 during an emission period to make current flow through the organic light emitting diode OLED. The threshold voltage of the second driving TFT DR2 may be shifted by the positive data voltage Vdata supplied during the emission period. During the non-emission period, a negative compensation voltage Vndi supplied to the second driving TFT DR2 to recover the variation of the threshold voltage of the second driving TFT DR2 varied by the positive data voltage Vdata back to the original state. A drain electrode of the second driving TFT DR2 is connected to the cathode electrode of the organic light emitting diode OLED, and a source electrode thereof is connected to a power line supplying a low-level power supply voltage VSS. The gate electrode of the second driving TFT DR2 is connected to the source electrode of the second switching TFT SW2 and one electrode of the second storage capacitor Cst via the second node n2.

The data driver 62 converts digital video data RGB from the timing controller 61 into a positive data voltage to supply them to the data lines D1 to Dm, and converts digital compensation data Ndi into a negative compensation voltage Vndi to supply them to the data lines D1 to Dm. The scan driver 63 sequentially supplies scan pulses in response to a control signal GDC from the timing controller 61 to the gate lines G1A to GnB. The timing controller 61 supplies digital video data RGB and digital compensation data Ndi to the data driver 62 and generates a timing control signal DDC and GDC controlling operation timing of the scan driver 63 and the data driver 62 using, for example, a vertical/horizontal synchronizing signal and a clock signal.

Figure 7:
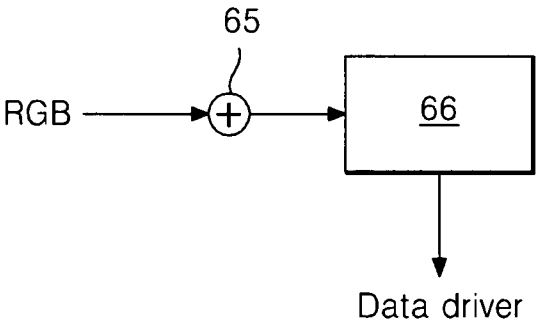
FIG. 7 is a circuit diagram showing a look-up table and an adder of a timing controller shown in FIG. 6.

The negative compensation voltage Vndi is determined in accordance with a data voltage Vdata. For example, in embodiments of the invention, through an experiential experiment, a data voltage Vdata is applied to the gate electrodes of the driving TFTs DR1 and DR2 during N frame periods (N is a positive integer) to measure a variation amount ΔVth of the threshold voltage of the driving TFTs DR1 and DR2, and a negative compensation voltage Vndi is applied to the gate electrodes of the driving TFTs DR1 and DR2 during N frame periods to measure a variation amount ΔVth of the threshold voltage of the driving TFTs DR1 and DR2. The timing controller 61 incorporates a look-up table 66 in which digital compensation data Ndi for recovering an amount of variation in threshold voltage caused by the positive data voltage Vdata, as shown in FIG. 7, are mapped to each data and an adder 65 for adding up digital video data RGB inputted during N frame periods. The timing controller 61 selects, in the look-up table 66, digital compensation data Ndi differing according to the sum of the data voltages Vdata supplied to each of the light emitting cells during N frame periods. Therefore, the negative compensation voltage Vndi outputted from the data driver 62 is varied according to positive data voltage Vdata supplied to the light emitting cells.

Figure 8:
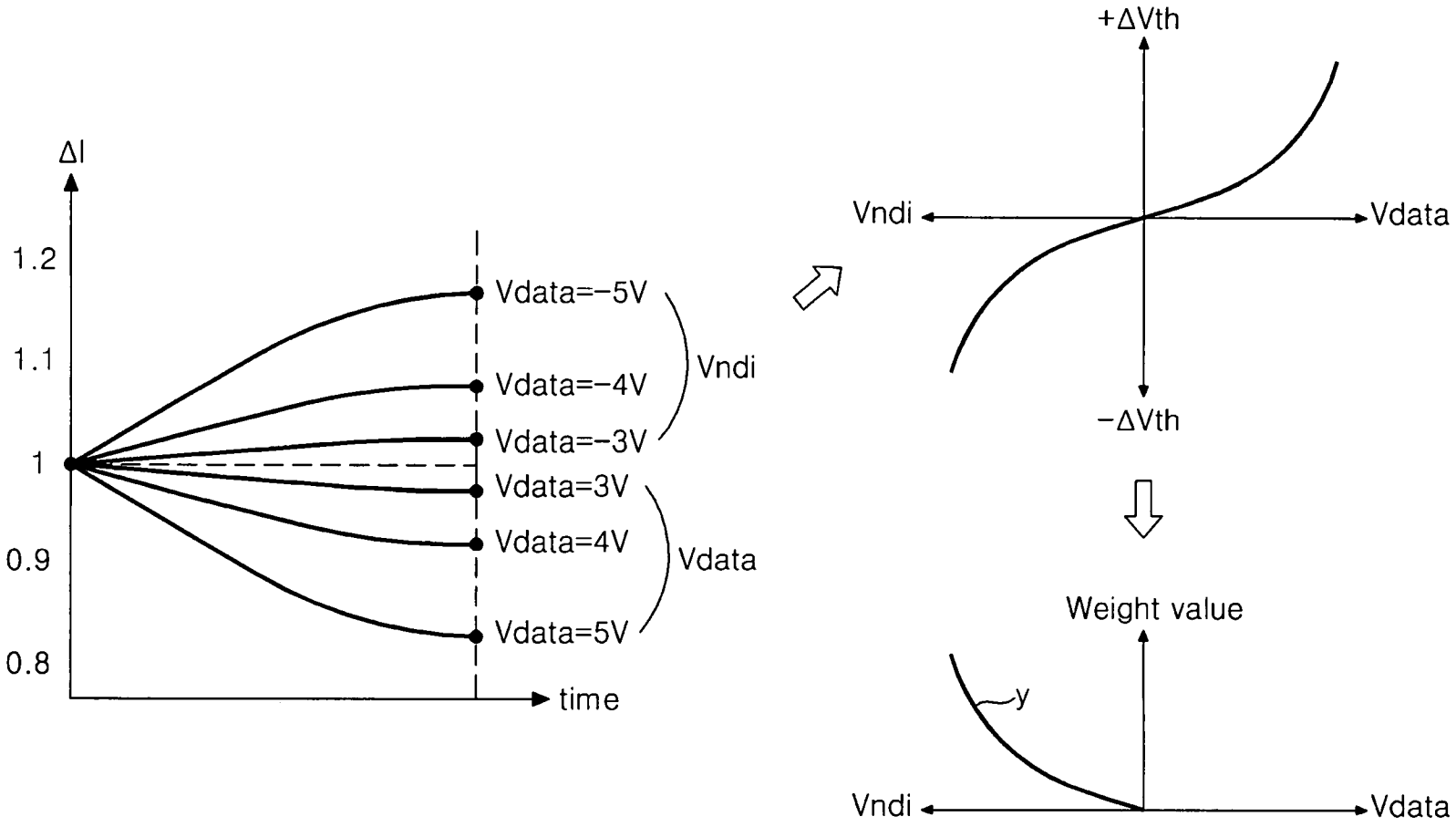
FIG. 8 is a view explaining a compensation voltage.

As shown in FIG. 8, if a positive data voltage Vdata is a voltage higher than a low-level power supply voltage VSS by 0 to 5V, a negative compensation voltage Vndi is selected according to a data voltage Vdata, and is a negative voltage lower than the low-level power supply voltage VSS by 0 to −5V. An absolute value of the positive data voltage Vdata and an absolute value of the negative compensation voltage Vndi may be proportional to each other. For example, if the positive data voltage Vdata is 5V, the negative compensation voltage Vndi is selected as −5V, and if the positive data voltage Vdata is 4V, the negative compensation voltage Vndi is selected as −4V.

FIG. 8 is a view explaining a negative compensation voltage Vndi. As shown in FIG. 8, a current variation amount ΔI of the organic light emitting diode OLED is not in direct proportion to a gate voltage of the driving TFTs DR1 and DR2. Hence, in embodiments of the invention, the variation ΔVth in the threshold voltage of the driving TFTs DR1 and DR2 varied during N frame periods is converted into a weight value y of a compensation voltage Vndi. The weight value y is determined as a value whose absolute becomes higher as the compensation voltage Vndi becomes higher. The weight value y and the compensation voltage Vndi are values satisfying the following Equation (2).

$$\Delta Vth = \sum_{t=0}^{N} \Delta Vth(t) = \sum_{t=0}^{N} f(Vndi(t)) = \sum_{t=0}^{N} Vy(t),\ Vy = Vndi \cdot y \tag{2}$$

Figure 9:
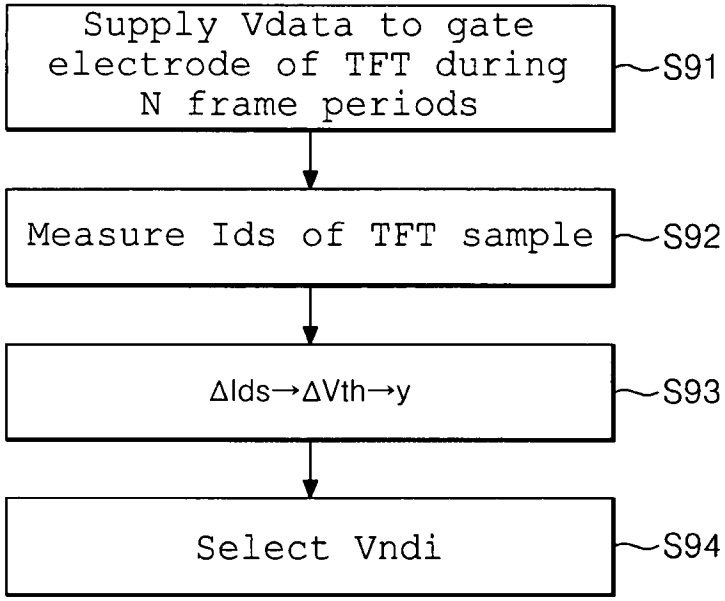
FIG. 9 is a flow chart explaining by stages a driving method of an organic light emitting diode display device according to the first embodiment of the invention.

FIG. 9 is a flow chart explaining by stages a driving method of an organic light emitting diode display device according to the first embodiment of the invention. Referring to FIG. 9, in the driving method of an organic light emitting diode display device according to the first embodiment of the invention, a data voltage Vdata is supplied to a gate electrode of a TFT during N frame periods, and drain-source current Ids of the TFT flowing by the data voltage Vdata is measured (S91 and S92). In the driving method of an organic light emitting diode display device according to the first embodiment of the invention, a current variation ΔIds of the TFT is converted into a variation ΔVth in the threshold voltage of the TFT, and then Vndi and y satisfying "Vth=Vndi×y" are determined. Digital compensation data Ndi corresponding to the compensation voltage Vndi is configured according to look-up table 66. Also, in the driving method of an organic light emitting diode display device according to the first embodiment of the invention, digital video data RGB are added up for each pixel during N frame periods, and the digital compensation data Ndi corresponding to the sum is selected from the look-up table 66 and supplied to the data driver 62. This digital compensation data Ndi is converted into a negative compensation voltage Vndi by the data driver 62, and supplied to gate electrodes of driving TFTs DR1 and DR2 via data lines D1 to Dm (S93 and S94).

Figure 10:
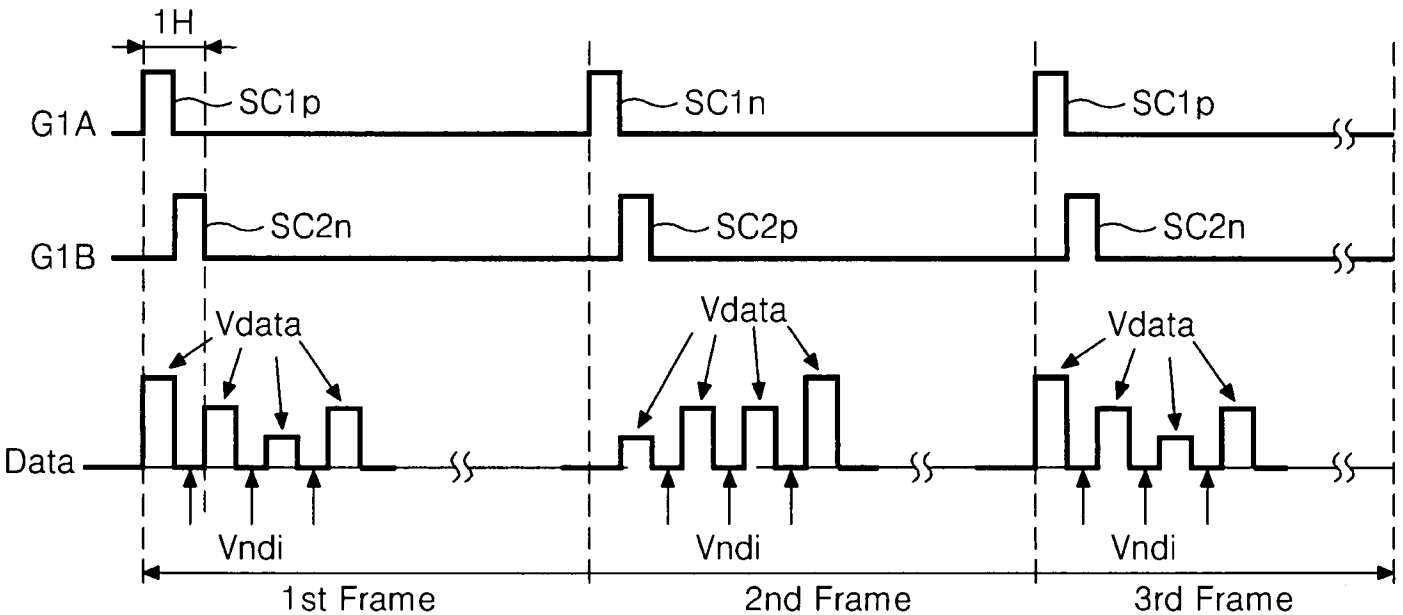
FIG. 10 shows a driving wave form of the organic light emitting diode display device according to the first embodiment of the invention.

FIG. 10 shows a driving wave form of the organic light emitting diode display device according to the first embodiment of the invention. The driving waveform of FIG. 10 shows an example of scan pulses SC1 and SC2, a positive data voltage, and a negative compensation voltage supplied to one light emitting cell as illustrated in FIG. 6. Referring to FIG. 10, the scan driver 63 supplies a first scan pulse SC1*p* synchronized with a positive data voltage Vdata to a 1A gate line G1A within one scan time (or one horizontal period 1H) of an odd frame period, and then supplies a second scan pulse SC2*n* synchronized with a negative compensation voltage Vndi to a 1B gate line G1B. Next, the scan driver 63 supplies a first scan pulse SC1*n* synchronized with a negative compensation voltage Vndi to the 1A gate line G1A within one scan time of an even frame period, and then supplies a second scan pulse SC2*p* synchronized with a positive data voltage Vdata to the 1B gate line G1B.

During the odd frame period, a positive data voltage Vdata is applied to the gate electrode of the first driving TFT DR1 and a negative compensation voltage Vndi is applied to the gate electrode of the second driving TFT DR2. During the even frame period, a negative compensation voltage Vndi is applied to the gate electrode of the first driving TFT DR1 and a positive data voltage Vdata is applied to the gate electrode of the second driving TFT DR2.

Subsequently, the first cell driving circuit SWD1 is driven in an emission period during the odd frame period to make the organic light emitting diode OLED emit light, and the second cell driving circuit SWD2 is driven in a non-emission period during the odd frame period to recover a variation in the threshold voltage of the second driving TFT DR2. On the contrary, the first cell driving circuit SWD1 is driven in the non-emission period during the even frame period to recover a variation in the threshold voltage of the first driving TFT DR1, and the second cell driving circuit SWD2 is driven in the emission period during the even frame period to make the organic light emitting diode OLED emit light.

Figure 11:
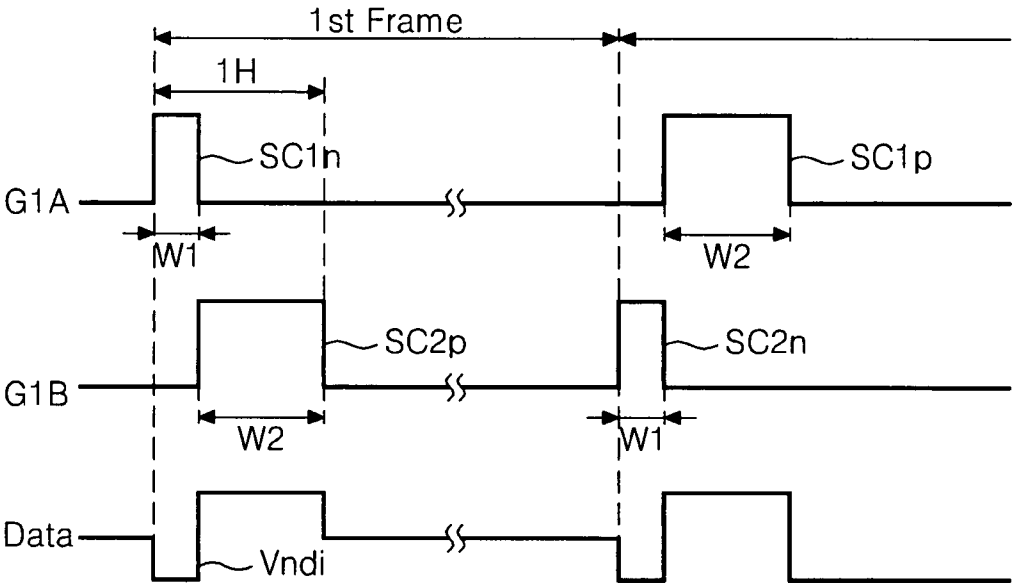
FIG. 11 shows another example of the driving wave form of the organic light emitting diode display according to the first embodiment of the invention.

The example of FIG. 10 is an example of scan pulses SC1*p*, SC2*p*, SC1*n* and SC2*n* divided into two during one scan time, and the duty ratio is 1:50 for the first scan pulse and 1:50 for the second scan pulse. Such a duty ratio can be adjusted as illustrated in FIG. 11. FIG. 11 shows another example of the driving wave form of the organic light emitting diode display according to the first embodiment of the invention. In an example of FIG. 11, the duty ratio of the scan pulses synchronized with the negative compensation voltage within one horizontal period is decreased, and the duty ratio of the scan pulses SC1*p* and SC2*p* synchronized with the positive data voltage Vdata is increased, thereby lengthening the time for applying the positive data voltage Vdata to the driving TFTs DR1 and DR2. The driving waveform of FIG. 11 shows an example of scan pulses SC1*p*, SC2, SC2*p*, and SC2*n*, a positive data voltage, and a negative compensation voltage supplied to one light emitting cell as illustrated in FIG. 6.

Referring to FIG. 11, within one scan time (or one horizontal period 1H) of an odd frame period, the scan driver 63 supplies a first scan pulse SC1N with a small width synchronized with a negative compensation voltage Vndi to a 1A gate line G1A, and then supplies a second scan pulse SC2*p* with a large width synchronized with a positive data voltage Vdata to a 1B gate line G1B. Next, within one scan time of an even frame period, the scan driver 63 supplies a second scan pulse SC2*n* with a small width synchronized with a negative compensation voltage Vndi to the 1B gate line G1B, and then supplies a first scan pulse SC1*p* with a large width synchronized with a positive data voltage Vdata to the 1A gate line G1A. The pulse widths W2 of the first and second scan pulses SC1*p* and SC2*p* synchronized with the positive data voltage Vdata are substantially the same, and are greater than the pulse widths W1 of the first and second scan pulses SC1*n* and SC2*n* synchronized with the negative compensation voltage Vndi.

During the odd frame period, a negative compensation voltage Vndi is applied to the gate electrode of the first driving TFT DR1 and a positive data voltage Vdata is applied to the gate electrode of the second driving TFT DR2. During the even frame period, a positive data voltage Vdata is applied to the gate electrode of the first driving TFT DR1 and a negative compensation voltage Vndi is applied to the gate electrode of the second driving TFT DR2.

Subsequently, the first cell driving circuit SWD1 is driven in a non-emission period during the odd frame period to recover a variation in the threshold voltage of the first driving TFT DR1, and the second cell driving circuit SWD2 is driven in an emission period during the odd frame period to make the organic light emitting diode OLED emit light. On the contrary, the first cell driving circuit SWD1 is driven in the emission period during the even frame period to make the organic light emitting diode OLED emit light, and the second cell driving circuit SWD2 is driven in the non-emission period during the even frame period to recover a variation in the threshold voltage of the second driving TFT DR2.

If a negative compensation voltage is applied within a limited time of one frame period, the effect of recovery of the threshold voltages of the driving TFTs DR1 and DR2 may be insufficient. To increase the effect of recovery of threshold voltage, as illustrated in FIG. 12, the emission period and non-emission period of the first cell driving circuit SWD1 and second cell driving circuit SWD2 may be alternately driven in a cycle of more than two frame periods.

Figure 12:
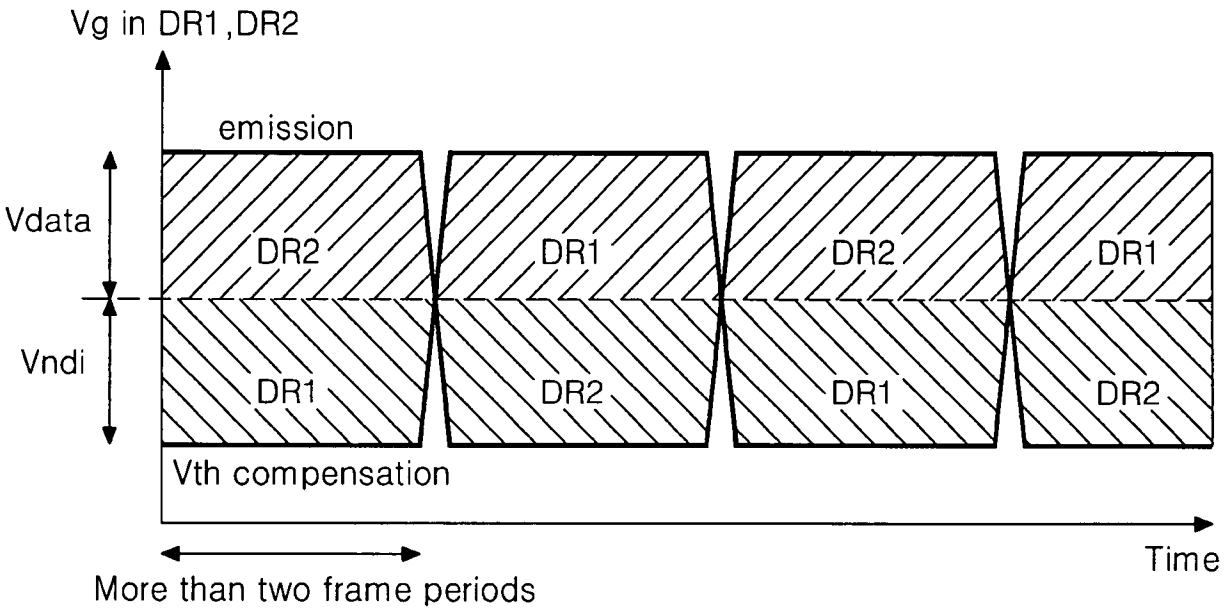
FIG. 12 is a view showing an example of alternate driving in a plurality of frame periods in the organic light emitting diode display device according to the first embodiment of the invention.

FIG. 12 is a view showing an example of alternate driving in a plurality of frame periods in the organic light emitting diode display device according to the first embodiment of the invention. Referring to FIG. 12, a first scan pulse SP1*n* synchronized with a negative compensation voltage Vndi is supplied to the 1A gate line G1A during more than two frame periods, and a second scan pulse SP2*p* synchronized with a positive data voltage Vdata is supplied to the 1B gate line G1B during the same period. During the same period, a negative compensation voltage Vndi is supplied to the gate electrode of the first driving TFT DR1 of the first cell driving circuit SWD1, and hence the first driving TFT DR1 recovers a variation amount of threshold voltage caused by the previous positive data voltage Vdata. A positive data voltage Vdata is supplied to the gate electrode of the second driving TFT DR2 of the second cell driving circuit SWD2, and hence the second riving TFT DR2 makes the organic light emitting diode OLED emit light.

Next, a first scan pulse SP1*p* synchronized with a positive data voltage Vdata is supplied to the 1A gate line G1A during more than two frame periods, and a second scan pulse SP2*n* synchronized with a negative compensation voltage Vndi is supplied to the 1B gate line G1B during the same period. During the same period, a positive data voltage Vdata is supplied to the gate electrode of the first driving TFT DR1 of the first cell driving circuit SWD1, and hence the first driving TFT DR1 makes the organic light emitting diode OLED emit light. A negative compensation voltage Vndi is supplied to the gate electrode of the second driving TFT DR2 of the second cell driving circuit SWD2, and hence the second riving TFT DR2 recovers a variation amount of threshold voltage caused by the previous positive data voltage Vdata.

Figure 13:
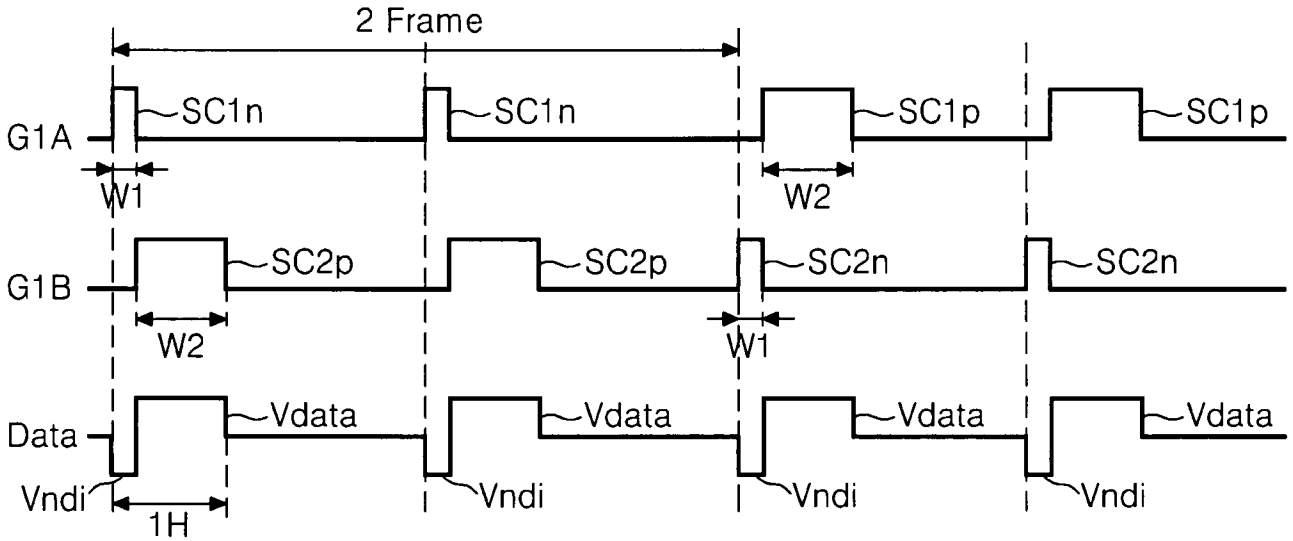
FIG. 13 shows an example of a driving waveform for alternately driving first and second cell driving circuits in a cycle of two frame periods.

FIG. 13 shows an example of a driving waveform for alternately driving first and second cell driving circuits in a cycle of two frame periods. Referring to FIG. 13, during (4*i*+1)th (i is an integer greater than 1) and (4*i*+2)th frame periods, the scan driver 63 supplies a first scan pulse SC1*n* with a small width W1 synchronized with a negative compensation voltage Vndi to a 1A gate line G1A, and then supplies a second scan pulse SC2*p* with a large width W2 synchronized with a positive data voltage Vdata to a 1B gate line G1B. Next, during (4*i*+3)th and (4*i*+4)th frame periods, the scan driver 63 supplies a first scan pulse SC1*p* with a large width W2 synchronized with a positive data voltage Vdata to the 1A gate line G1A, and then supplies a first scan pulse SC2*n* with a small width W1 synchronized with a negative compensation voltage Vndi to the 1B gate line G1B. The pulse widths W2 of the first and second scan pulses SC1*p* and SC2*p* synchronized with the positive data voltage Vdata are substantially the same, and are greater than the pulse widths W1 of the first and second scan pulses SC1*n* and SC2*n* synchronized with the negative compensation voltage Vndi.

During the (4*i*+1)th and (4*i*+2)th frame periods, a negative compensation voltage Vndi is applied to the gate electrode of the first driving TFT DR1 and a positive data voltage Vdata is applied to the gate electrode of the second driving TFT DR2. During the (4*i*+3)th and (4*i*+4)th frame periods, a positive data voltage Vdata is applied to the gate electrode of the first driving TFT DR1 and a negative compensation voltage Vndi is applied to the gate electrode of the second driving TFT DR2.

Subsequently, the first cell driving circuit SWD1 is driven to a non-emission period during the (4*i*+1)th and (4*i*+2)th frame periods to recover a variation in the threshold voltage of the first driving TFT DR1, and the second cell driving circuit SWD2 is driven to an emission period during the (4*i*+1)th and (4*i*+2)th frame periods to make the organic light emitting diode OLED emit light. On the contrary, the first cell driving circuit SWD1 is driven to the emission period during the (4*i*+3)th and (4*i*+4)th frame periods to make the organic light emitting diode OLED emit light, and the second cell driving circuit SWD2 is driven to the non-emission period during the (4*i*+3)th and (4*i*+4) to recover a variation in the threshold voltage of the second driving TFT DR2.

There may be a case where it is difficult to completely compensate for a variation ΔVth in the threshold voltage of the driving TFTs DR1 and DR2 caused by the data voltage Vdata with the use of the negative compensation voltage Vndi alone. This means that |Vdata|=|Vndi| is not satisfied, but the weight value Vy of the negative compensation voltage for compensating for a threshold voltage shift may be |Vdata|>|Vy| or |Vdata|<|Vy, which is dependent upon the electrical properties of amorphous silicone TFT (a-Si:H TFT). If |Vdata|<|Vy, Vy exceeding the operating voltage range of an integrated circuit IC of the data driver cannot be generated in the integrated circuit. Also, with the use of the negative compensation voltage Vndi alone, there may be a limit on the amount of compensation of the threshold voltage of the driving TFTs DR1 and DR2.

The respective light emitting cells in the display panel are supplied with different data voltages. Due to this, the degree of degradation of the threshold voltage of the driving TFTs DR1 and DR2 is different in the respective light emitting cells. Accordingly, in embodiments of the invention, an amount of variation in threshold voltage is defined as a total of variations in the threshold voltage of the driving TFTs DR1 and DR2 generated during N frame periods. Although a negative compensation voltage Vndi of such driving TFTs DR1 and DR2 has to be applied as an optimal voltage different for each pixel, an optimized negative compensation voltage Vndi has to be selected from an infinite number of voltages, and its voltage range exists within the range of gamma voltages. Thus, there is a limitation in applying an optima negative compensation voltage Vndi to each pixel.

There may be a case in which a negative compensation voltage Vndi cannot be respectively applied to each pixel for reasons concerned with the driving of the display panel. For instance, if a large-area, high-resolution display panel is driven at a frame frequency of 120 Hz to apply both a positive data voltage Vdata and a negative compensation voltage Vndi to the pixels, there may occur a problem, such as insufficient scan time in the pixels. Because it is difficult to apply a negative compensation voltage Vndi to each pixel, a certain representative negative compensation voltage Vndi may be applied to every pixel. In this case, the threshold voltage of the driving TFTs DR1 and DR2 cannot be completely compensated for the respective pixels, and hence a data voltage can be modulated for the compensation of the deficiency.

Subsequently, in the above-stated case, there is a need to produce a negative compensation voltage Vndi as a voltage near an optimal voltage capable of ideally compensating for the threshold voltage of the driving TFTs DR1 and DR2, and to modulate a data voltage Vdata in correspondence with the threshold voltage of the driving TFTs DR1 and DR2 to compensate for the insufficient amount of compensation as in the embodiment to be described below.

Figure 14:
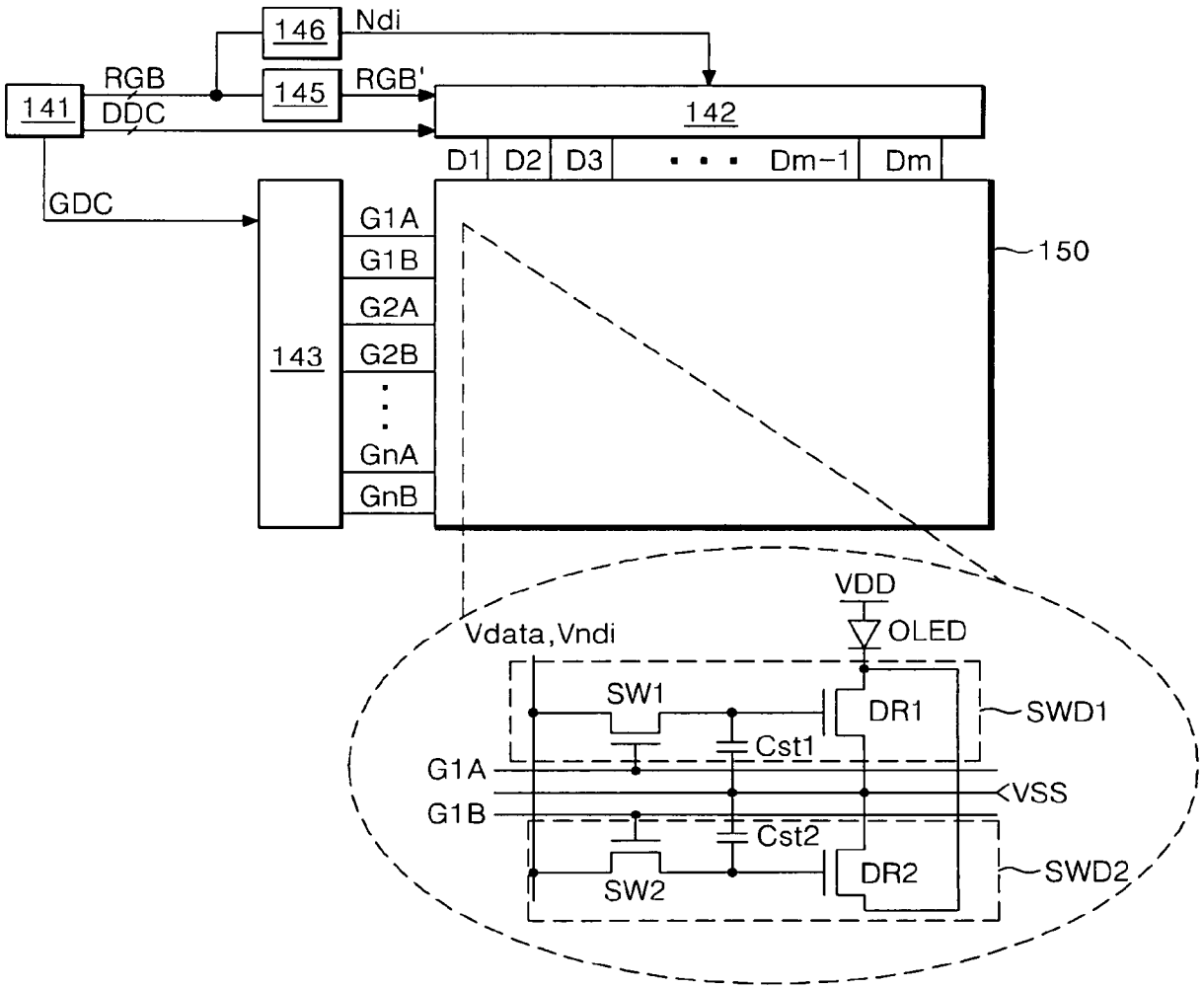
FIG. 14 shows an organic light emitting diode display device according to a second embodiment of the invention.

FIG. 14 shows an organic light emitting diode display device according to a second embodiment of the invention. Referring to FIG. 14, the organic light-emitting diode display device according to the second embodiment of the invention includes a display panel 150 provided with an m×n number of light emitting cells, a data modulator 145 for modulating digital video data RGB, a compensation data generator 146 for generating digital compensation data, a data driver 142 for converting modulated digital video data RGB' and digital compensation data into analog voltages and supplying them to data lines D1 to Dm, a scan driver 143 for sequentially supplying scan pulses to gate lines G1A to GnB, and a timing controller 141 for controlling the drivers 142 and 143. In the display panel 150, light emitting cells are formed in light emitting cell areas defined by a crossing of gate lines G1A to GnB and data lines D1 to Dm. A high-level power supply voltage VDD and a low-level power supply voltage VSS are supplied to each of the light emitting cells of the display panel 150. The gate lines are paired to drive one pixel row. The gate line pairs G1A and G1B, G2A and G2Bm, . . . , GnA and GnB include two gate lines to which scan pulses are sequentially inputted.

Each of the light emitting cells is provided with first and second cell driving circuits SWD1 and SWD2 for alternately driving the organic light emitting diode OLED. The first and second cell driving circuits SWD1 and SWD2 are substantially the same as those in the foregoing embodiment.

In the memory of the data modulator 145, modulated data RGB', which are determined based on the correlation between original data voltages Vdata added up during N frame periods and variations in the threshold voltage Vth of the driving TFTs DR1 and DR2, are stored in a look-up table form. The modulated data RGB' of the look-up table are values obtained by giving a first weight value x to the original digital video data RGB, and are optimized for each gray scale of the original digital video data RGB. As the first weight value x, a weight value satisfying the following Equation (3) is determined, at which a data voltage Vdata is modulated by threshold voltage of the driving TFTs DR1 and DR2 caused by the original data voltage Vdata during N frame periods. The data modulator 145 modulates data by multiplying the original digital video data RGB input for each light emitting cell during N frame periods by the first weight value x.

$$\Delta Vth = \sum_{t=0}^{N} \Delta Vth(t) = \sum_{t=0}^{N} f(Vdata(t)) = \sum_{t=0}^{N} Vx(t),\ Vx = Vdata \cdot x \tag{3}$$

In the memory of the compensation data generator 146, second weight values y and digital compensation data Ndi are stored in a look-up table form. As the second weight value y and the digital compensation data Ndi, values satisfying Equation 1 are determined. The compensation data generator 146 selects, in the look-up table, the digital compensation data Ndi and second weight value y corresponding to the amount of variation ΔVth in the threshold voltage of the driving TFTs DR1 and DR2 caused by the sum of the digital video data RGB inputted during N frame periods. The compensation data generator 146 generates a compensation value obtained by multiplying the digital compensation data Ndi by the second weight value y. The data modulator 145 and the compensation data generator 146 can share one memory, as shown in FIG. 15.

The data driver 142 converts the digital video data RGB' modulated by the data modulator 145 into a positive data voltage Vdata', and converts the digital compensation data Ndi from the compensation data generator 146 into a negative compensation voltage. The positive data voltage Vdata' and negative data voltage Vndi generated from the data driver 142 are supplied to the gate electrodes of the driving TFTs DR1 and DR2 through the data lines D1 to Dm and switching TFTs SW1 and SW2. The scan driver 143 sequentially supplies scan pulses SC1*p*, SC1*n*, SC2*p*, and SC2*n* in response to a control signal GDC from the timing controller 141 to the gate lines G1A to GnB. The timing controller 141 supplies digital video data RGB and digital compensation data Ndi to the data driver 142 and generates a timing control signal DDC and GDC controlling an operation timing of the scan driver 143 and the data driver 142 using, for example, a vertical/horizontal synchronizing signal and a clock signal.

Figure 15:
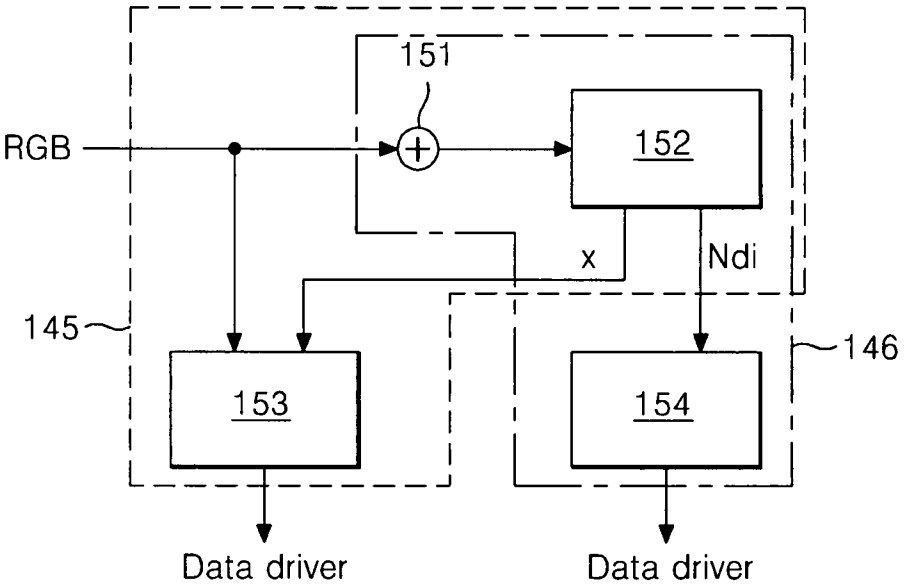
FIG. 15 is a circuit diagram showing in detail the data modulator and the compensation data generator as shown in FIG. 14.

FIG. 15 is a circuit diagram showing in detail the data modulator 145 and the compensation data generator 146. Referring to FIG. 15, the data modulator 145 includes an adder 151, a memory 152, and a modulating circuit 153, and the compensation data generator 146 includes an adder 151, a memory 152, and a compensation data generating circuit 154. The adder 151 adds digital video data RGB for N frame periods, and supplies the sum to the memory 152.

The memory 152 stores a look-up table in which first and second weight values x and y and digital compensation data Ndi are listed. The memory 152 selects weight values x and y and digital compensation data Ndi by using the sum of digital video data from the adder 151 as a read address. Then, the memory 152 supplies the selected first weight value x to the digital modulating circuit 153, and supplies the selected second weight value y and digital compensation data Ndi to the compensation data generating circuit 154.

The digital modulating circuit 153 multiplies digital video data RGB by a first weight value x such that a data voltage may be modulated by the threshold voltage of the driving TFTs DR1 and DR2 caused by the original data voltage Vdata during N frame periods. The compensation data generating circuit 154 generates a compensation value by multiplying the digital compensation data Ndi inputted from the memory 152 by the second weight value.

Figure 16:
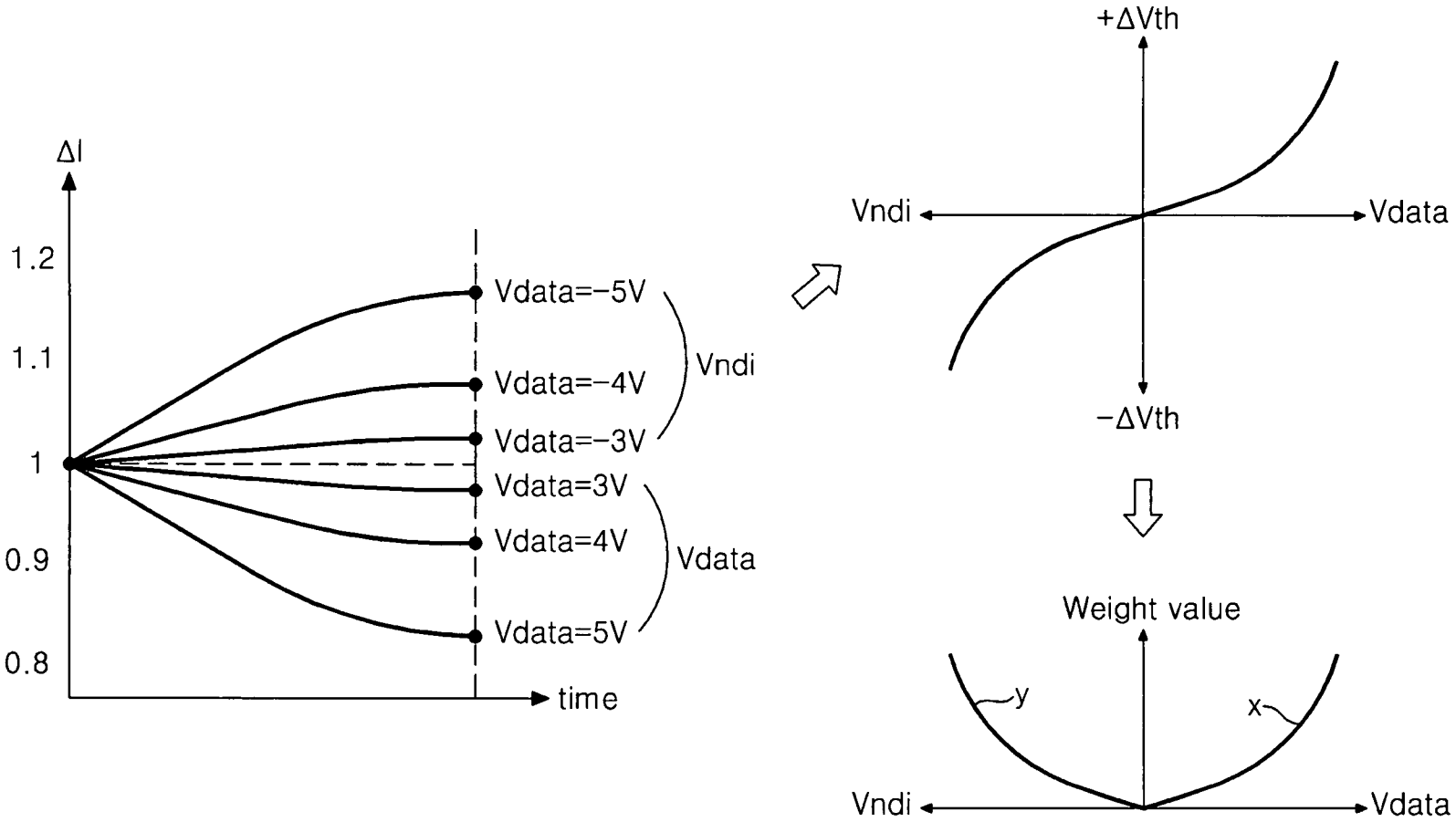
FIG. 16 is a graph showing a data voltage, a compensation voltage, and weight values.

FIG. 16 is a view explaining first and second weight values x and y. As shown in FIG. 16, when a positive data voltage Vdata is supplied to the gate electrodes of the driving TFTS DR1 and DR2 during N frame periods, source-drain current of the driving TFTs DR1 and DR2 is changed according to the application time and voltage level of the positive data voltage Vdata. When a negative compensation voltage Vndi is supplied to the electrodes of the driving TFTs DR1 and DR2 during N frame periods, source-drain current of the driving TFTs DR1 and DR2 is changed according to the application time and voltage level of the compensation voltage Vndi.

The higher the absolute value voltage of the positive data voltage Vdata or negative compensation voltage Vndi supplied to the gate electrodes of the driving TFTs DR1 and DR2, and the longer the application time of the positive data voltage Vdata or negative compensation voltage Vndi, the greater the source-drain current of the driving TFTs DR1 and DR2 due to an increase in the threshold voltage of the driving TFTs DR1 and DR2. The source-drain current of the driving TFTs DR1 and DR2 is not in direction proportion to the threshold voltage of the driving TFTs DR1 and DR2. Therefore, "original data voltage Vdata+amount of variation in threshold voltage of driving TFTs DR1 and DR2" is determined as the first weight value x such that a data voltage to be supplied to each pixel may be adjusted, and "opposite polarity voltage of original data voltage Vdata+amount of variation in threshold voltage of driving TFTs DR1 and DR2" is determined as the second weight value y such that a compensation voltage to be supplied to each light emitting cell may be adjusted.

Figure 17:
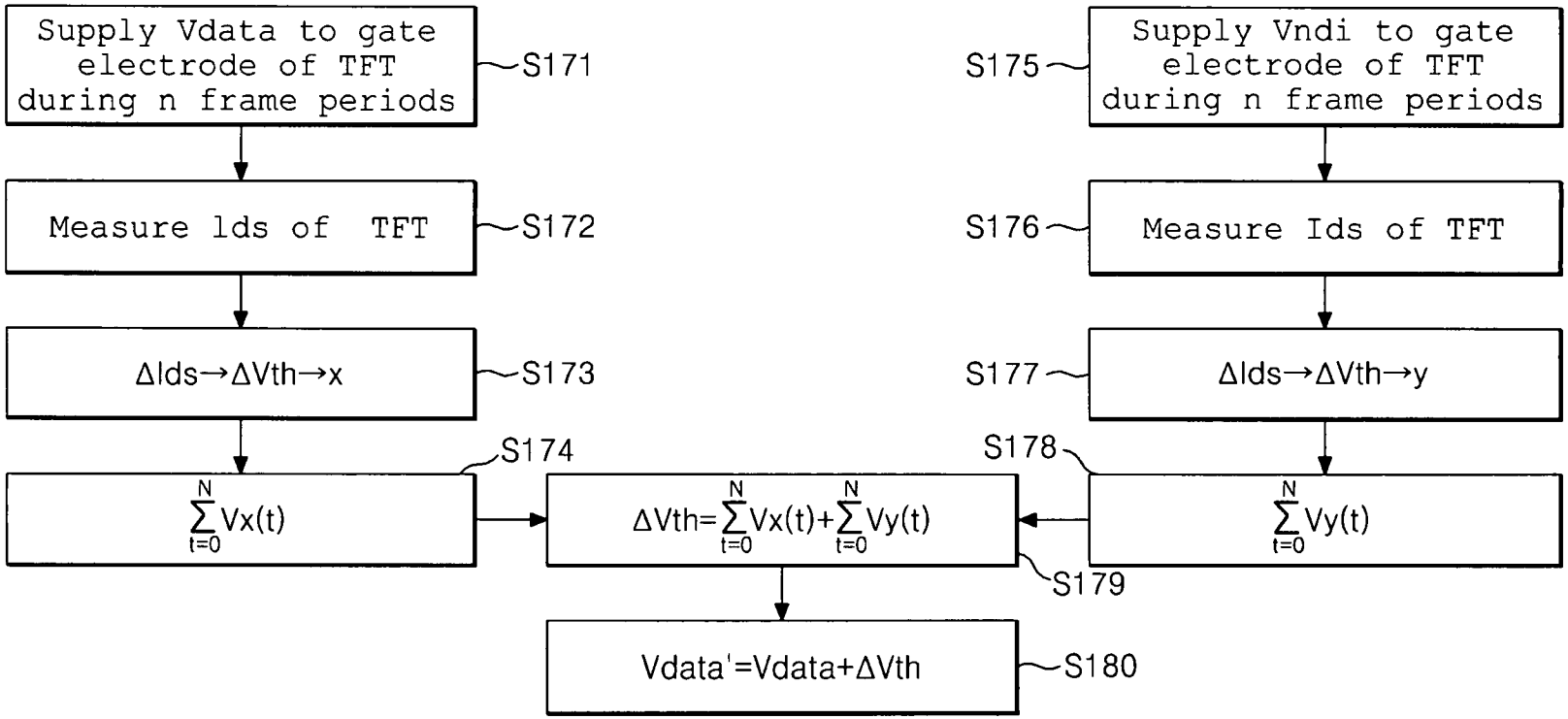
FIG. 17 is a flow chart explaining by stages a driving method of an organic light emitting diode display device according to the second embodiment of the invention.

FIG. 17 is a flow chart explaining by stages a driving method of an organic light emitting diode display device according to the second embodiment of the invention. Referring to FIG. 17, in the driving method of an organic light emitting diode display device according to the second embodiment of the invention, a positive data voltage Vdata is supplied to a gate electrode of a TFT during N frame periods, and drain-source current Ids of the TFT flowing by the data voltage Vdata is measured (S171 and S172). Next, a current variation ΔIds of the TFT is converted into a variation ΔVth in the threshold voltage of the TFT, and then the variation ΔVth in threshold voltage is converted into a first weight value x (S173 and S174). Also, during N frame periods, a negative compensation voltage Vndi is supplied to the gate electrode of the TFT, and drain-source current Ids flowing by the compensation voltage Vndi is measured (S175 and S176). Next, a current variation Δids of the TFT is converted into a variation ΔVth in the threshold voltage of the TFT, and then the variation ΔVth in threshold voltage is converted into a second weight value y (S177 and S178).

The variation in the threshold voltage of the driving TFTs DR1 and DR2 caused by the positive data voltage and the negative compensation voltage is judged to be "Vx+Vy=(Vdata×x)+(Vndi×y)" (S179). This amount of variation ΔVth in threshold voltage is added to digital video data RGB, and converted into a data voltage Vdata' by the data driver 152 (S180).

Figure 18:
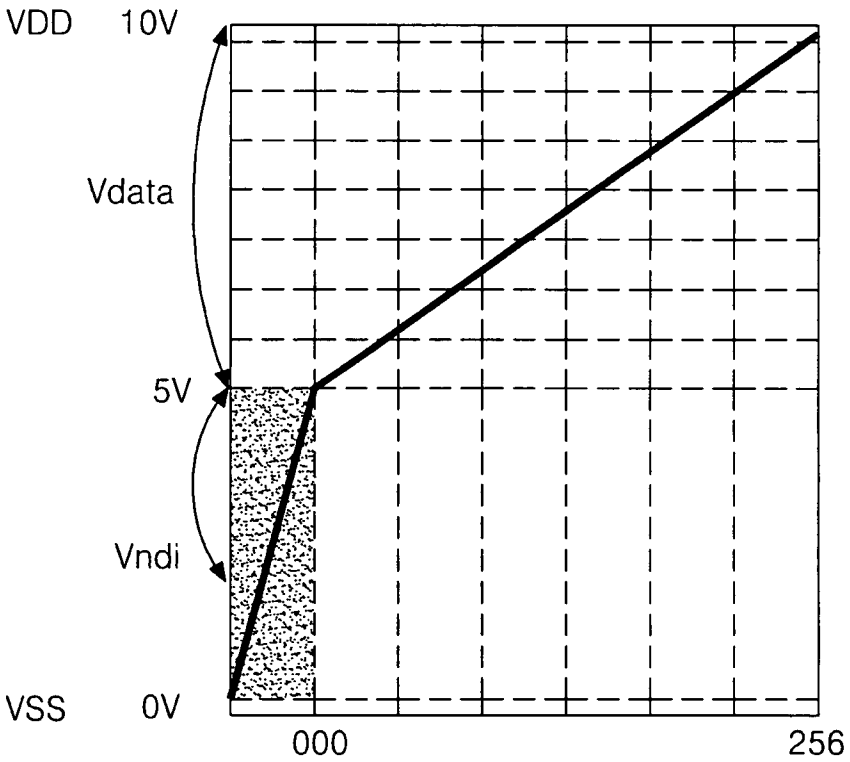
FIG. 18 is a graph showing a positive data voltage and a negative compensation voltage.

FIG. 18 shows a positive data voltage and a negative compensation voltage. In FIG. 18, the horizontal axis represents gamma compensation voltage, while the longitudinal axis represents gray scale. If the driving TFTs DR1 and DR2 are implemented in an n-type MOS-FET, as shown in FIG. 18, a positive data voltage represents a gray scale of digital video data at a voltage between 5V and 10V, and a compensation voltage is generated at a voltage between 0V and 5V, is unable to represent a gray scale, and recovers an amount of variation in the threshold voltage of the driving TFTs DR1 and DR2.

An amount of variation+Δth in the positive threshold voltage of the driving TFTs DR1 and DR2 generated by the positive data voltage Vdata during N frame periods is obtained from the first weight value of the look-up table, and the negative compensation voltage Vndi is obtained from the second weight value y corresponding to the amount of variation −Δth with the same amplitude (absolute value voltage) as that of the amount of variation+Δth in positive threshold voltage. FIG. 19 shows an example of a look-up table.

First and second weight values x and y are determined based on the amount of variation in the threshold voltage of the driving TFTs DR1 and DR2 during tens of to thousands of frame periods. This is because the amount of variation in the threshold voltage of the driving TFTs DR1 and DR2 is small during a short period of time.

Based on an experiential experiment, the first weight value x is determined so as to meet $$\sum_{t=0}^{N} Vth(t) = \sum_{t=0}^{N} Vdata(t) \times x,$$

and the second weight value y is determined so as to meet $$\sum_{t=0}^{N} Vth(t) = \sum_{t=0}^{N} Vndi(t) \times y.$$

The thusly determined first and second weight values x and y are configured in the look-up table as illustrated in FIG. 19.

When Vdata=3V and Vndi=4V, the amount of variation Δth in the threshold voltage of the driving TFFs DR1 and DR2 is the same, and hence $$\sum_{t=0}^{N} Vx(t) = \sum_{t=0}^{N} Vy(t) = 0$$

is satisfied. In contrast, if Vdata=5V, $$\sum_{t=0}^{N} Vx(t) = \sum_{t=0}^{N} Vy(t) = 0.3 - 0.24 = 0.06$$

even if the compensation voltage Vndi is −5V. Subsequently, when the positive data voltage Vdata is 3V, the compensation voltage Vndi is generated by 4V×0.05, and when the positive data voltage Vdata is 5V, the data voltage is modulated to be generated by Vx=Vdata+0.06, and the compensation voltage Vndi is generated by −5V×0.048.

The negative compensation voltage Vndi and second weight value y generated during N frame periods satisfy the following Equation (4).

$$\Delta Vth = \sum_{t=0}^{N} \Delta Vdata(t) \cdot x(t) = |N \cdot Vndi \cdot y| \tag{4}$$

For example, if it is assumed that the amount of variation in the threshold voltage of the driving TFTs DR1 and DR2 caused by the positive data voltage Vdata applied during 100 frame periods is 0.24V, digital compensation data Ndi of the negative compensation voltage Vndi for shifting the threshold voltage of the driving TFTs DR1 and DR2 during 100 frame periods, i.e., satisfying "100×Vndi×y=−0.24" is selected from the look-up table. Meanwhile, in a case where the look-up table is composed of 50 frames, the look-up table may be modified according to the driving of 100 frames as illustrated in FIG. 20.

Figure 21:
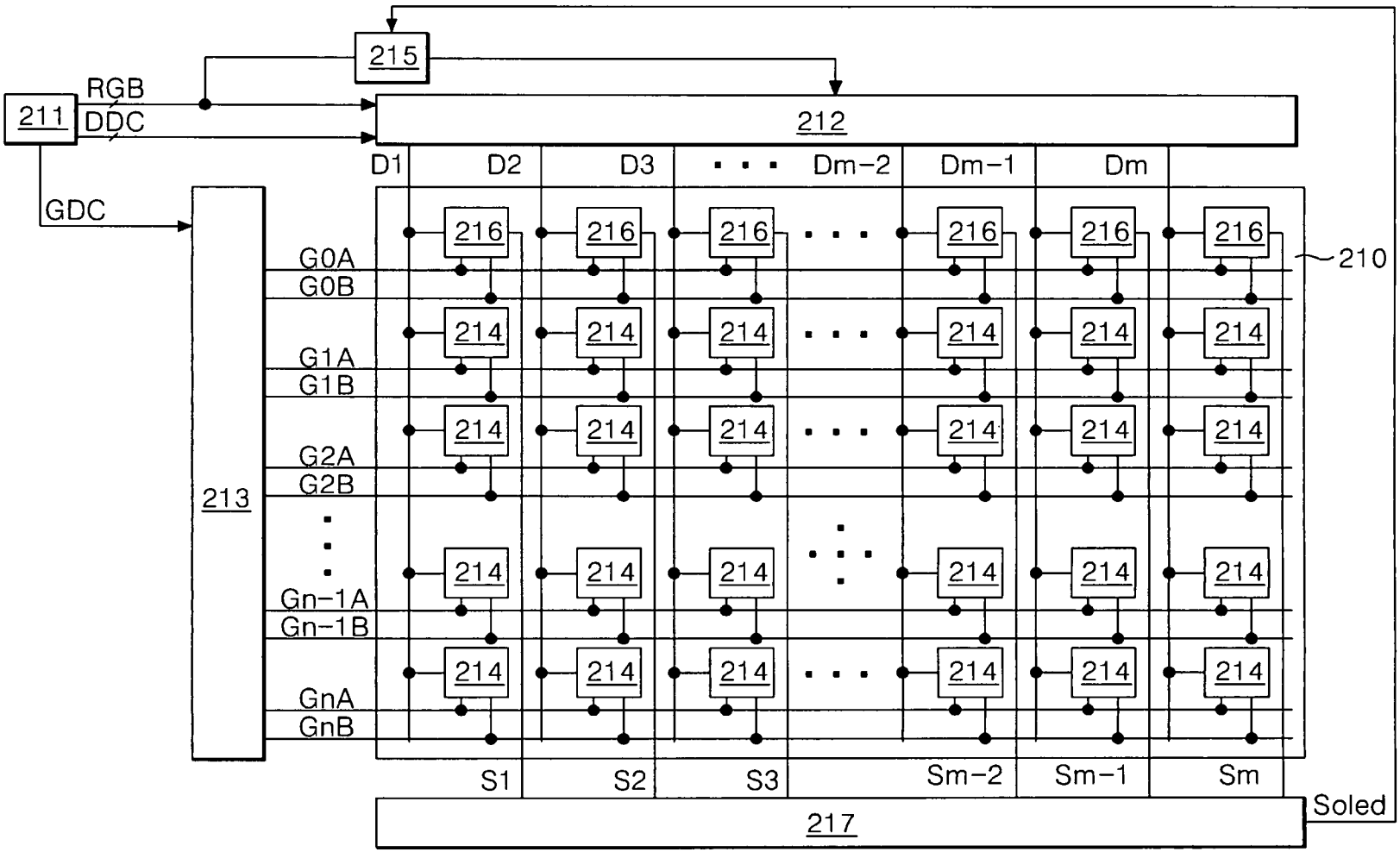
FIG. 21 is a block diagram showing an organic light emitting diode display device according to a third embodiment of the invention.
Figure 22:
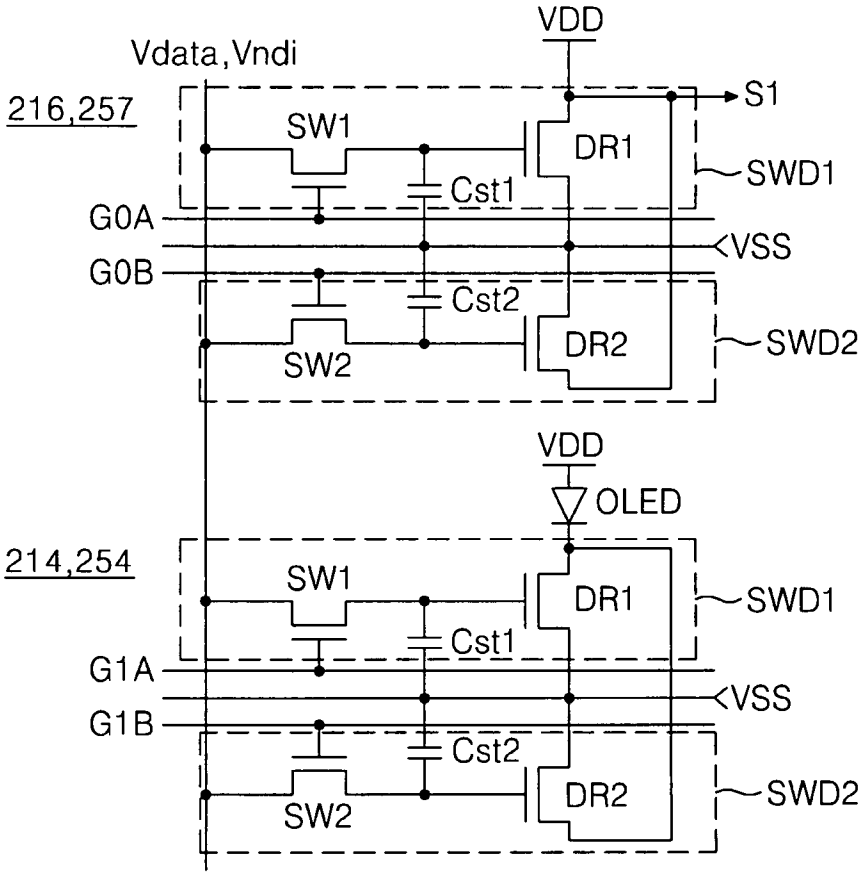
FIG. 22 is an equivalent circuit diagram of the sensors and light emitting cells shown in FIG. 21.

FIGS. 21 and 22 show an organic light emitting diode display device according to a third embodiment of the invention. Referring to FIGS. 21 and 22, the organic light-emitting diode display device according to the third embodiment of the invention includes a display panel 210 provided with an m×n number of light emitting cells 214 for displaying video data and a sensor 216 in each column of the display panel 210 for sensing current of the light emitting cells 214, a compensation data generator 215 for generating digital compensation data Ndi, a data driver 212 for converting digital video data RGB and digital compensation data Ndi into a positive data voltage Vdata and a negative compensation voltage Vndi, respectively, and supplying them to data lines D1 to Dm, a scan driver 213 for sequentially supplying scan pulses to gate lines G0A to GnB, a sensor data generator 217 for converting the current sensed by the sensor 216 and supplying it to the compensation data generator 215, and a timing controller 251 for controlling the drivers 212 and 213.

In the display panel 210, wires, such as data lines D1 and Dm, sensor lines S1 to Sm, and gate lines G0A to GnB crossing the lines D1 to Dm and S1 to Sm are formed. Light emitting cells 214 and sensors 216 are formed in pixel areas defined by a crossing of gate lines G0A to GnB and data lines D1 to Dm. The sensor lines S1 to Sm parallel to the data lines D1 to Dm are connected to the sensors 216. A high-level power supply voltage VDD and a low-level power supply voltage VSS are supplied to the respective light emitting cells 214 and the respective sensors 216. Each of the light emitting cells is provided with first and second cell driving circuits SWD1 and SWD2 for alternately driving the organic light emitting diode OLED.

The sensors 216 include the first and second cell driving circuits SWD1 and SWD2 identical to those of the light emitting cells 214 except that they have no organic light emitting diode OLED and the sensors lines S1 to Sm are connected to them unlike the light emitting cells 214. The first and second cell driving circuits SWD1 and SWD2 of the sensors 216 are alternately driven in an emission period and a non-emission period. The first and second cell driving circuits SWD1 and SWD2 of the sensors 216 are turned on in response to scan pulses from a pair of dummy gate lines G0A and GOB to supply current generated by the driving of the driving TFTs DR1 and DR2 to the sensors lines S1 to Sm. This current is generated from the same circuit as the circuits of the light emitting cells 214. Therefore, the sensors serve to sense current flowing through the organic light emitting diodes OLEDs of the light emitting cells 214.

In the memory of the compensation data generator 215, there are stored weight values y and digital compensation data for recovering the amount of variation Δth in the threshold voltage of the driving TFTs DR1 and DR2 based the correlation between original data voltages Vdata added up during N frame periods and variations in the threshold voltage Vth of the driving TFTs DR1 and DR2. The weight values y are stored as values satisfying Equation 1 in the memory.

Such a compensation data generator 215 adds digital video data RGB inputted during N frame periods for each light emitting cell 214, and multiplies digital compensation data Ndi by a weight value y corresponding to the sum. Also, the compensation data generator 215 supplies the digital compensation data Ndi multiplied by the weight value y to the data driver 212.

The data driver 212 converts the digital video data from the timing controller 211 and the digital compensation data Ndi from the compensation data generator 215 into analog voltages to be supplied to each of the light emitting cells through the data lines D1 to Dm. A positive data voltage Vdata generated from the digital video data RGB and a negative compensation voltage Vndi generated from the digital compensation data are supplied to the data lines D1 to Dm.

The scan driver 213 sequentially supplies scan pulses in response to a control signal GDC from the timing controller 211 to the gate lines G0A to GnB. The timing controller 211 supplies digital video data RGB and digital compensation data Ndi to the data driver 212 and generates a timing control signal DDC and GDC controlling an operation timing of the scan driver 213 and the data driver 212 using, for example, a vertical/horizontal synchronizing signal and a clock signal. The sensor data generator 217 converts the current from the sensors 216 into digital data and supplies it to the compensation data generator 215.

Figure 23:
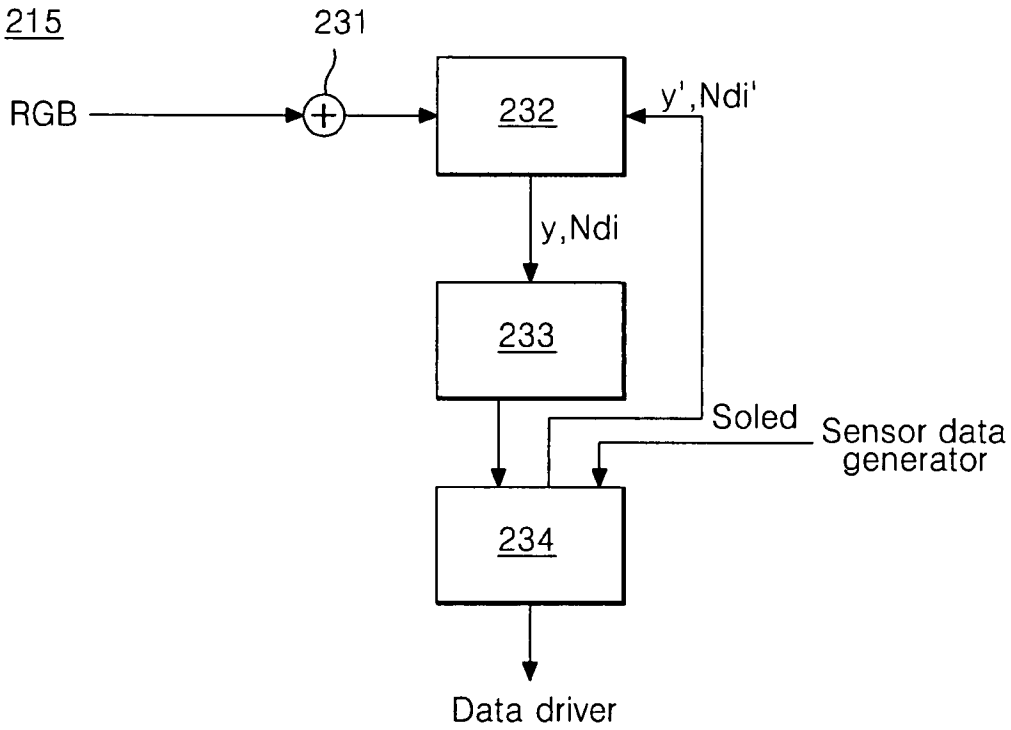
FIG. 23 is a circuit diagram showing in detail the compensation data generator as shown in FIG. 21.

FIG. 23 is a circuit diagram showing in detail a compensation data generator 215. Referring to FIG. 23, the compensation data generator 215 includes an adder 231, a memory 232, a digital compensation data generating circuit 233, and a comparator 234. The adder 231 adds digital video data RGB for N frame periods, and supplies the sum to the memory 232.

The memory 232 stores a look-up table in which weight values y and digital compensation data Ndi corresponding to the amount of variation in the threshold voltage of the driving TFTs DR1 and DR2 caused by a compensation voltage Vndi are listed. The memory 232 outputs the weight values digital compensation data Ndi by using the sum of digital video data RGB from the adder 231 as a read address.

The digital compensation data generating circuit 233 multiplies digital compensation data Ndi by a weight value y from the memory 232 and supplies them to the comparator 234.

The comparator 234 includes a look-up table storing the correlation between a negative compensation voltage Vndi supplied to the light emitting cells 214 and the threshold voltage of the driving TFTs DR1 and DR2. The comparator 234 converts sensor data Soled from the sensor data generator 217 and digital compensation data Ndi from the digital compensation data generating circuit 233 into amounts of variations in the threshold voltage of the driving TFTs DR1 and DR2, and compares the converted values with each other to detect in real time a variation Δth in the threshold voltage of the driving TFTs DR1 and DR2 caused by a negative compensation voltage Vndi. As a result of comparison, if it is judged that the threshold voltage of the driving TFTs DR1 and DR2 is changed by a negative compensation voltage Vndi, the comparator 234 adjusts the weight values y and digital compensation data Ndi stored in the memory 232 to reduce variations in threshold voltage.

Figure 24:
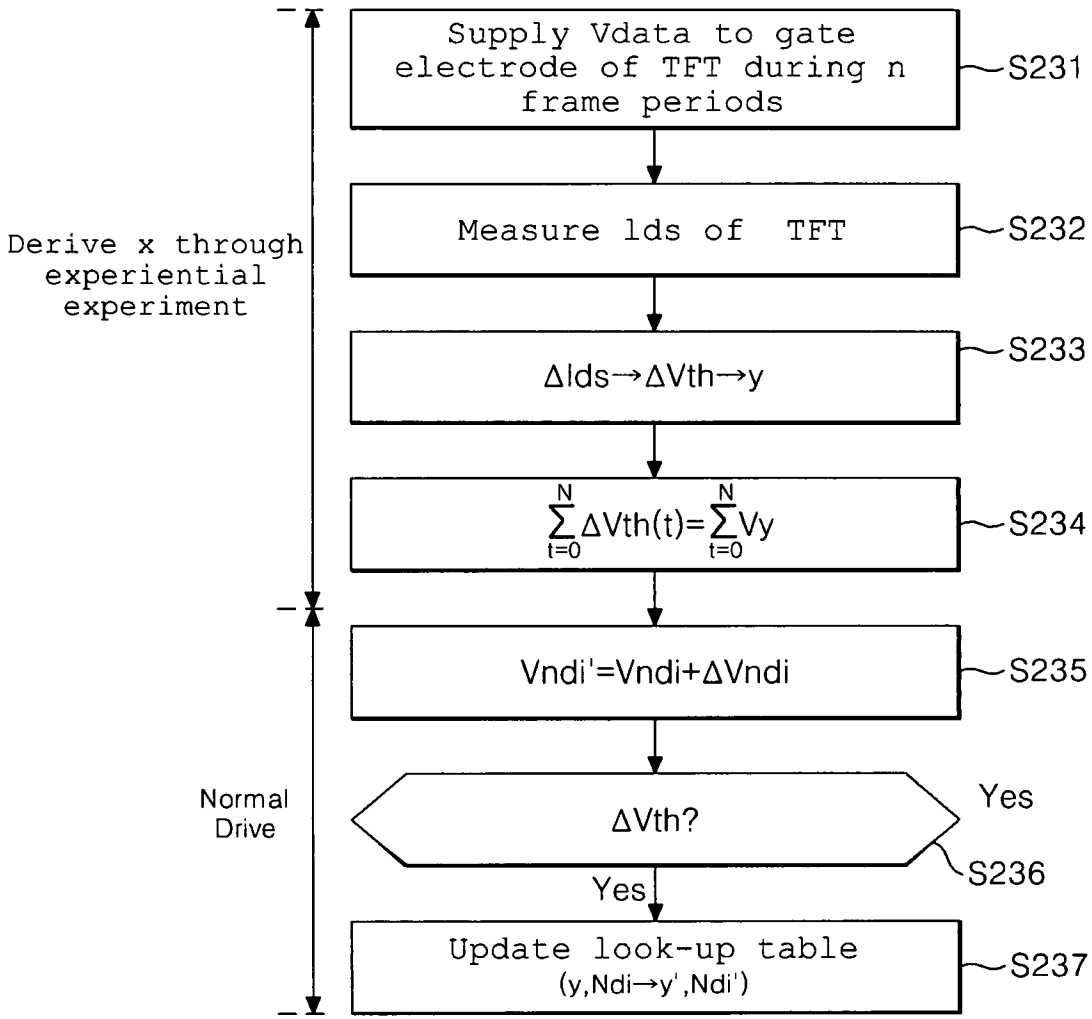
FIG. 24 is a flow chart explaining by stages a driving method of an organic light emitting diode display device according to the third embodiment of the invention.

FIG. 24 is a flow chart explaining by stages a driving method of an organic light emitting diode display device according to the third embodiment of the invention. Referring to FIG. 24, in the driving method of an organic light emitting diode display device according to the third embodiment of the invention, a data voltage Vdata and a compensation voltage Vth of the opposite polarity are supplied to a gate electrode of a TFT during N frame periods, and drain-source current Ids of the TFT flowing by the compensation voltage Vndi is measured (S231 and S232).

Next, a current variation ΔIds of the TFT is converted into a variation ΔVth in the threshold voltage of the TFT, and then the variation ΔVth in threshold voltage is converted into a weight value y (S233 and S234). The thusly obtained weight value y and the digital compensation data Ndi corresponding to the negative compensation voltage Vndi are configured as a look-up table, and the look-up table is stored in the memory 232 of the compensation data generator 215.

The compensation data generator 215 adds digital video data RGB for each pixel, and selects the digital compensation data and weight value y corresponding to the sum in the look-up table (S235). The digital compensation data multiplied by the weight value y is converted into a negative compensation voltage (Vndi'=Vndi+ΔVndi) by the data driver 212 and supplied to gate electrodes of driving TFTs DR1 and DR2 and a storage capacitor C through the data lines D1 to Dm and a switching circuit 301. Here, "ΔVndi" is a voltage added by a negative compensation voltage Vndi to compensate for an amount of variation in the threshold voltage of the driving TFTs DR1 and DR2 caused by the negative compensation voltage Vndi. Further, the compensation data generator 215 judges whether the threshold voltage of the driving TFTs DR1 and DR2 is varied or not by comparing the threshold voltage of the driving TFTs DR1 and DR2 senseed from the sensors 216 in the display panel 210 and the compensation voltage Vndi. If it is judged that the threshold voltage is varied, the weight value y and digital compensation data Ndi of the look-up table are updated to a value for converging the variation in threshold voltage to '0' (S236 and S237).

Figure 25:
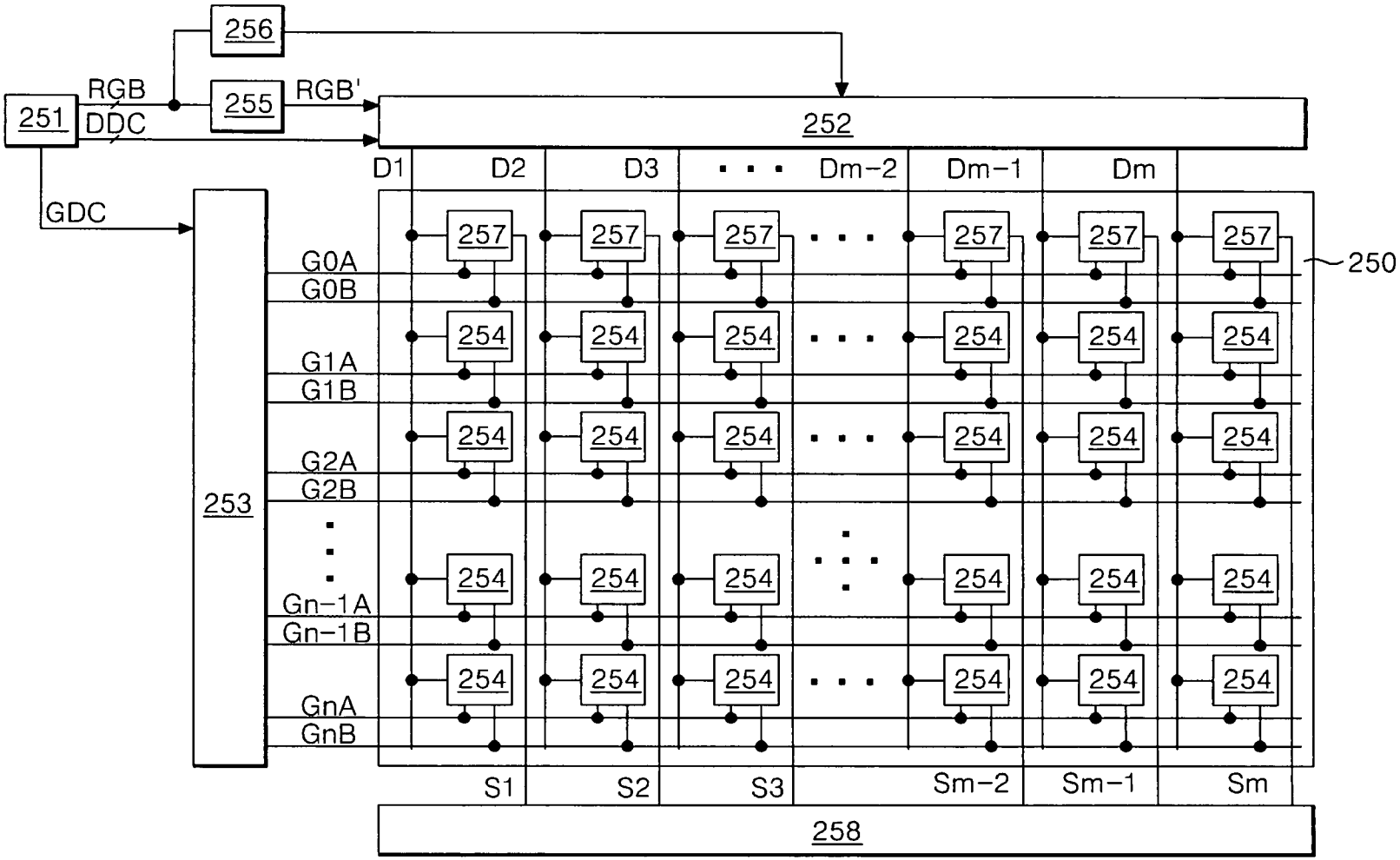
FIG. 25 shows an organic light emitting diode display device according to a fourth embodiment of the invention.

FIG. 25 shows an organic light emitting diode display device according to a fourth embodiment of the invention. Referring to FIGS. 22 and 25, the organic light-emitting diode display device according to the fourth embodiment of the invention includes a display panel 250 provided with an m×n number of light emitting cells 254 for displaying video data and a sensor 257 in each column of the display panel 250 for sensing current of the light emitting cells 254, a data modulator 255 for modulating digital video data RGB, a compensation data generator 256 for generating digital compensation data Ndi, a data driver 252 for converting modulated digital video data RGB' and digital compensation data Ndi into a positive data voltage Vdata' and a negative compensation voltage Vndi, respectively, a scan driver 253 for sequentially supplying scan pulses to gate lines G0A to GnB, a sensor data generator 258 for converting the current sensed by the sensor 257 and supplying it to the data modulator 255 and the compensation data generator 256, and a timing controller 211 for controlling the drivers 252 and 253.

In the display panel 250, wires, such as data lines D1 and Dm, sensor lines S1 to Sm, and gate lines G0 to Gn crossing the lines D1 to Dm and S1 to Sm are formed. Light emitting cells 254 and sensors 257 are formed in pixel areas defined by the crossing of the gate lines G0 to Gn and the data lines D1 to Dm. The sensor lines S1 to Sm parallel to the data lines D1 to Dm are connected to the sensors 257. A high-level power supply voltage VDD and a low-level power supply voltage VSS are supplied to the respective light emitting cells 254 and the respective sensors 257 of the display panel 250. The light emitting cells 254 and the sensors 257 respectively include first and second cell driving circuits SWD1 and SWD2.

In the memory of the data modulator 255, there is stored a look-up table LUT in which first weight values x are listed, the first weight values x being determined based on the correlation between positive data voltages and variations in the threshold voltage Vth of the driving TFTs DR1 and DR2. The first weight values satisfy Equation 2. The data modulator 255 modulates digital video data RGB by multiplying the digital video data RGB by a first weight value x corresponding to an sum of the digital video data RGB input for each light emitting cell during N frame periods.

Figure 26:
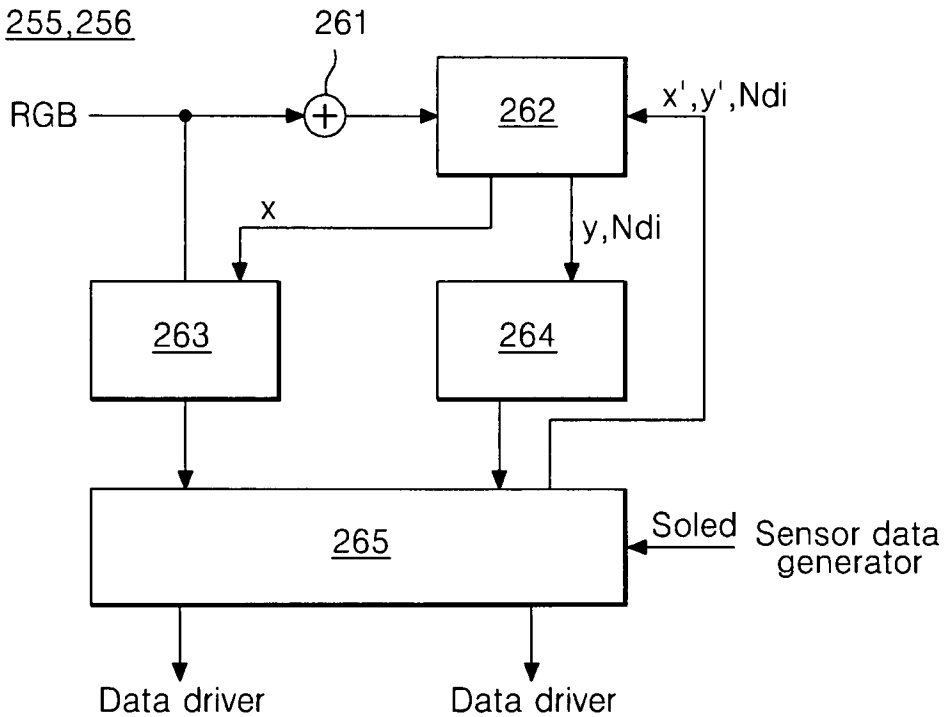
FIG. 26 is a block diagram showing in detail the data modulator and the compensation data generator.

In the memory of the compensation data generator 256, there is stored a look-up table LUT in which second weight values y and digital compensation data Ndi are listed. The second weight values y are determined as values corresponding to the amount of variation in the threshold voltage of the driving TFTs DR1 and DR2 caused by a negative compensation voltage Vndi based on the correlation between the compensation voltage Vndi and the threshold voltage of the driving TFTs DR1 and DR2. The compensation data generator 256 selects the second weight value y and digital compensation data Ndi corresponding to the amount of variation ΔVth in the threshold voltage of the driving TFTs DR1 and DR2 caused by the sum of the digital video data RGB inputted during N frame periods. The compensation data generator 256 multiplies the digital compensation data Ndi by the second weight value y. The data modulator 255 and the compensation data 255 can share one memory, as illustrated in FIG. 26. The data driver 252 converts the digital video data RGB' modulated by the data modulator 145 into a positive data voltage Vdata', and converts the digital compensation data Ndi from the compensation data generator 256 into a negative compensation voltage.

The scan driver 253 sequentially supplies scan pulses SC1*p*, SC1*n*, SC2*p*, and SC2*n* in response to a control signal GDC from the timing controller 141 to the gate lines G1A to GnB.

The timing controller 251 supplies digital video data RGB and digital compensation data Ndi to the data modulator 255 and generates a timing control signal DDC and GDC controlling an operation timing of the scan driver 253 and the data driver 252 using, for example, a vertical/horizontal synchronizing signal and a clock signal.

FIG. 26 is a circuit diagram showing in detail the data modulator 255 and the compensation data generator 256. Referring to FIG. 26, the data modulator 255 includes an adder 261, a memory 262, a digital modulating circuit 263, and a comparator 265, and the compensation data generator 256 includes an adder 261, a memory 262, a digital compensation data generating circuit 264, and a comparator 265.

The adder 261 adds digital video data RGB for N frame periods, and supplies the sum to the memory 262.

The memory 262 stores a look-up table in which first and second weight values x and y and digital compensation data Ndi are listed. The memory 152 selects weight values x and y and digital compensation data Ndi by using the sum of digital video data from the adder 261 as a read address.

The digital modulating circuit 263 generates modulated digital video data RGB' by multiplying digital video data RGB by a first weight value x such that a data voltage Vdata' to be supplied to each light emitting cell may be modulated by "positive data voltage Vdata+threshold voltage of driving TFTs DR1 and DR2" during N frame periods.

The digital compensation data generating circuit 264 generates a digital compensation value such that a negative compensation voltage Vndi to be supplied to each light emitting cell 154 may be adjusted by "compensation voltage Vndi+ΔVndi".

The comparator 265 includes a look-up table storing the correlation between a positive data voltage Vdata and the threshold voltage of the driving TFTs DR1 and DR2 and the correlation between a negative compensation voltage Vndi and the threshold voltage of the driving TFTs DR1 and DR2. The comparator 265 converts sensor data Soled from the sensor data generator 258 and digital video data RGB' from the digital modulating circuit 263 into amounts of variations in the threshold voltage of the driving TFTs DR1 and DR2, and compares the converted values with each other to detect in real time a variation Δth in the threshold voltage of the driving TFTs DR1 and DR2 caused by a data voltage Vdata. Also, the comparator 265 converts sensor data Soled from the sensor data generator 258 and digital compensation data Ndi from the digital compensation data generating circuit 264 into amounts of variations in the threshold voltage of the driving TFTs DR1 and DR2, and compares the converted values with each other to detect in real time a variation Δth in the threshold voltage of the driving TFTs DR1 and DR2 caused by a compensation voltage Vndi. As a result of comparison, if it is judged that the threshold voltage of the driving TFTs DR1 and DR2 is changed by a modulated data voltage Vs or compensation voltage Vndi, the comparator 234 adjusts the first and second weight values x and y and digital compensation data Ndi stored in the memory 312 to reduce variations Δth in threshold voltage.

Figure 27:
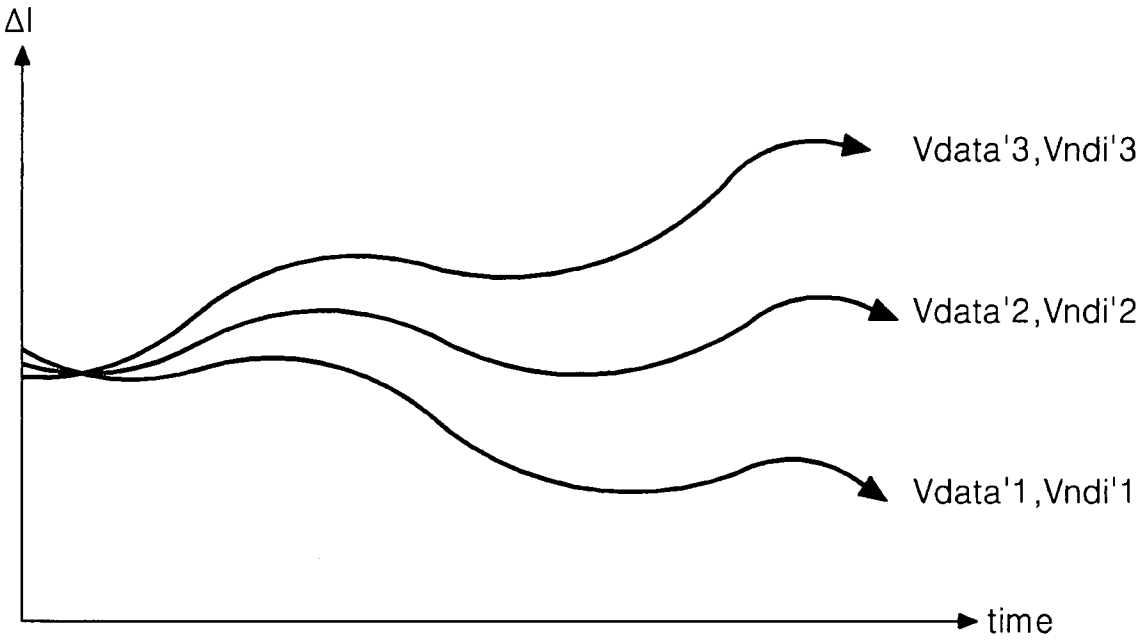
FIG. 27 is a view showing the control of a data voltage and a compensation voltage

The data modulator 255 adjusts the first weight value x according to current of the organic light emitting diode OLED detected in real time by the comparator 265 to converge the current of the organic light emitting diode OLED to initial current. In FIG. 27, it is assumed that a data voltage Vdata' outputted from the data modulator 255 by the digital video data RGB added up during N frame periods is 'Vdata'1'. If the current of the organic light emitting diode OLED is reduced with the passage of time relative to current by the Vdata' 1, the comparator 265 senses such a variation of the current, adjusts the first weight value x to an upper level to increase the data voltage to 'Vdata'2' or 'Vdata'3', thereby converging the current of the organic light emitting diode OLED to initial current.

Likewise, the compensation data generator 256 adjusts the second weight value y according to current of the organic light emitting diode OLED detected in real time by the comparator 265 to converge the current of the organic light emitting diode OLED to initial current. In FIG. 27, it is assumed that a compensation voltage Vndi generated during N frame periods is 'Vndi'1. If the current of the organic light emitting diode OLED is reduced with the passage of time relative to current by the Vndi'1, the comparator 265 senses such a variation of the current, adjusts the second weight value xy and/or digital compensation data to an upper level to increase the absolute value to 'Vndi'2' or 'Vndi'3', thereby converging the current of the organic light emitting diode OLED to initial current.

Figure 28:
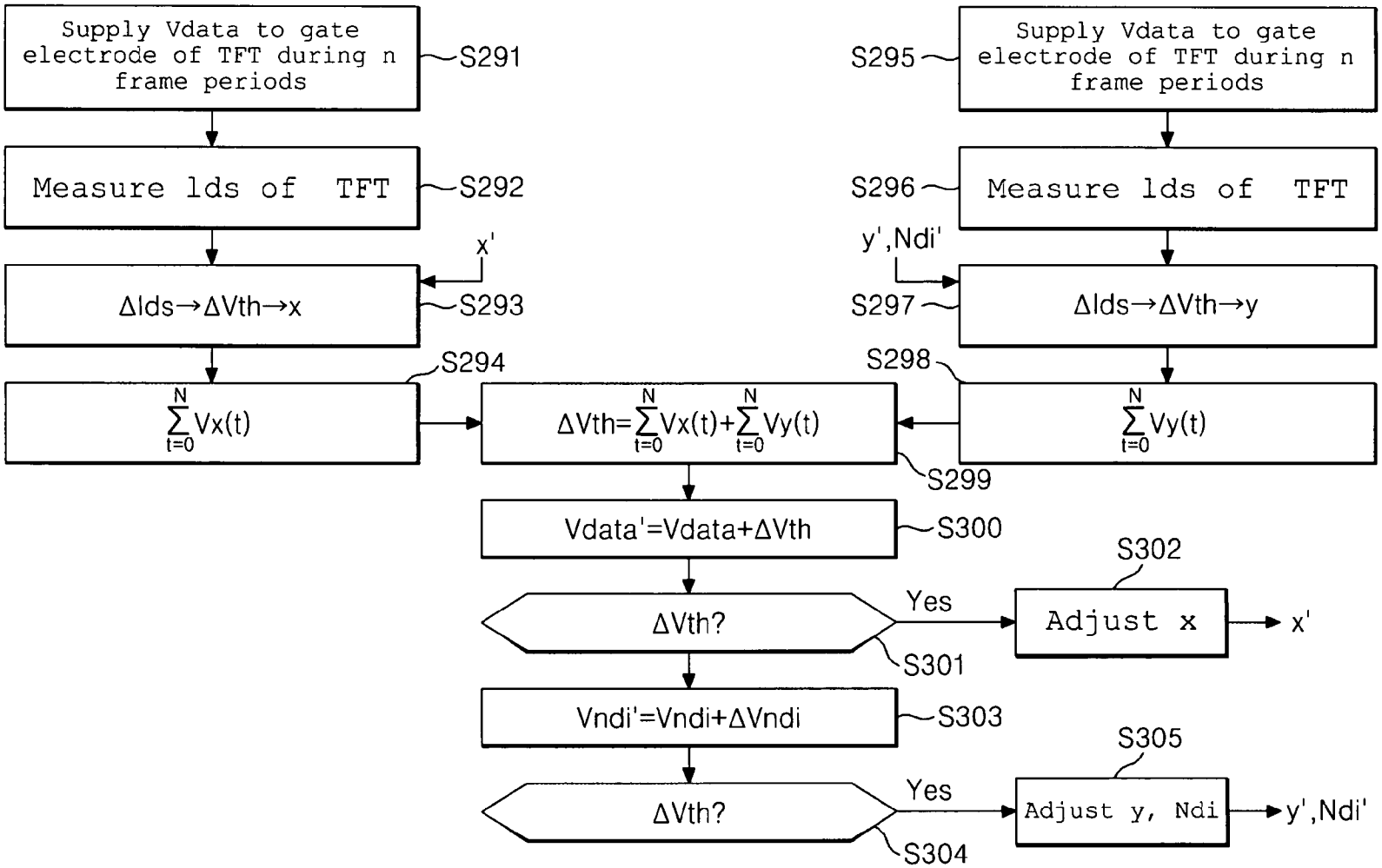
FIG. 28 is a flow chart showing a driving method of an organic light emitting diode according to the fourth embodiment of the invention.

FIG. 28 is a flow chart explaining by stages a driving method of an organic light emitting diode display device according to the fourth embodiment of the invention. Referring to FIG. 28, in the driving method of an organic light emitting diode display device according to the fourth embodiment of the invention, a positive data voltage Vdata is supplied to a gate electrode of a TFT during N frame periods, and drain-source current Ids of the TFT flowing by the data voltage Vdata is measured (S291 and S292). Next, a current variation ΔIds of the TFT is converted into a variation ΔVth in the threshold voltage of the TFT, and then the variation ΔVth in threshold voltage is converted into a first weight value x (S293 and S294).

Also, during N frame periods, a negative compensation voltage Vndi is supplied to the gate electrode of the TFT, and drain-source current Ids flowing by the compensation voltage Vndi is measured (S295 and S296). Next, the negative compensation voltage Vndi is converted into digital compensation data Ndi, a current variation Δids of the TFT is converted into a variation ΔVth in the threshold voltage of the TFT, and then the variation ΔVth in threshold voltage is converted into a second weight value y (S297 and S298).

The weight values x and y and the digital compensation data Ndi are mapped for each pixel of digital video data RGB and configured as a look-up table, and the look-up table is stored in a memory 262.

The amount of variation in the threshold voltage of the driving TFTs DR1 and DR2 is the sum of weight voltages added up during N frame periods (S299). A data voltage Vdata' outputted from the data driver 252 is the sum of the amount of variation ΔVth in the threshold voltage of the driving TFTs DR1 and DR2 and a positive data voltage Vdata (S300).

The data modulator 255 judges whether the threshold voltage of the driving TFTs DR1 and DR2 is varied or not by comprising the amount of variation in the threshold voltage of the driving TFTs DR1 and DR2 detected from the sensors 257 in the display panel 250 and the negative compensation voltage Vndi. If it is judged that the threshold voltage is varied, the first weight value x of the look-up table is updated to a value for converging the variation in threshold voltage to '0' (S301 and S302).

To recover the variation in threshold voltage, the digital compensation data Ndi is converted into a negative compensation voltage Vndi and supplied to the gate electrodes of the driving TFTs DR1 and DR2 through the data lines D1 to Dm (S303). At the same time, the compensation data generator 256 judges whether the threshold voltage of the driving TFTs DR1 and DR2 is varied or not by comprising the amount of variation in the threshold voltage of the driving TFTs DR1 and DR2 detected from the sensors 257 in the display panel 250 and the negative compensation voltage Vndi. If it is judged that the threshold voltage is varied, the second weight value y and/or digital compensation data Ndi of the look-up table is updated to a value for converging the variation in threshold voltage to '0' (S304 and S305).

In the third and fourth embodiments of the invention, the current sensed by the sensors 216 and 257 is analyzed according to gray scales of video data, and the compensation amount of the threshold voltage of the driving TFTs can be controlled differently according to gray scales of video data. Further, in the third and fourth embodiments of the invention, the display panel is virtually divided into a plurality of blocks having a constant size. Then, the current of a pixel existing at a specific position in one of the blocks may be sensed and the degree of degradation of the threshold voltage of the driving TFT may be judged according to the current, to thus supply a compensation voltage corresponding to a variation in threshold voltage to all light emitting cells of the block. Alternatively, the degree of degradation of the threshold voltage of the driving TFTs DR1 and DR2 may be judged based on the average value of data in one of the blocks, to thus supply a compensation voltage corresponding to a variation in threshold voltage to all light emitting cells of the block.

Figure 29:
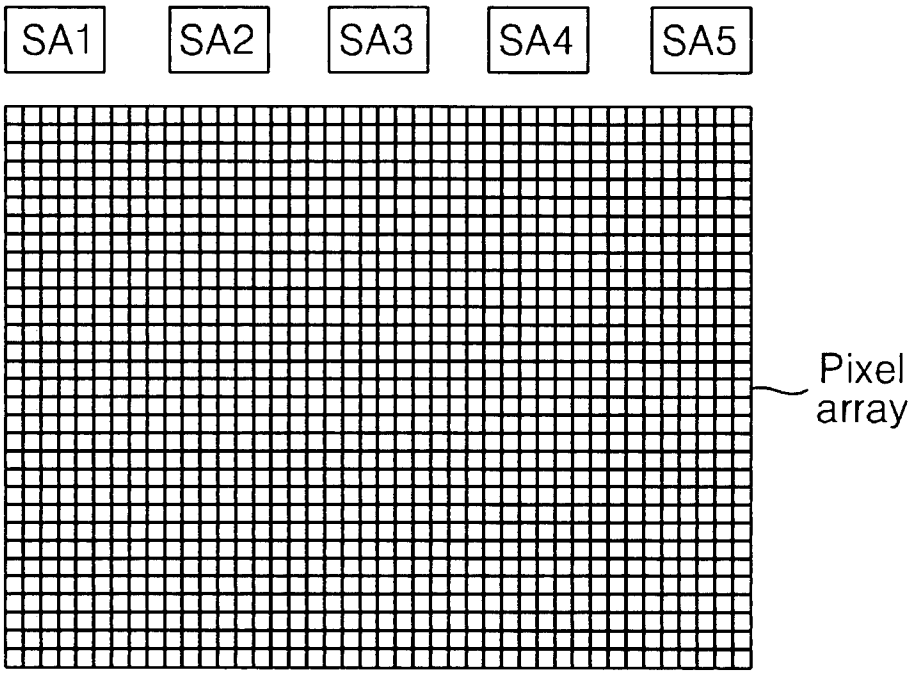
FIG. 29 is a view showing one example of sensor arrays divided by group.

The sensors 216 and 257 may not be arranged for each horizontal resolution, but may be divided into five sensor array groups SA1 to SA5 as illustrated in FIG. 29.

In the foregoing embodiments, the data modulator and the compensation data generator may be incorporated in the timing controller. Also, in the foregoing embodiments, the memory storing the look-up table is preferably an EEPROM (electrically erasable and programmable read only memory) which is capable of updating information of the look-up table.

Figure 30:
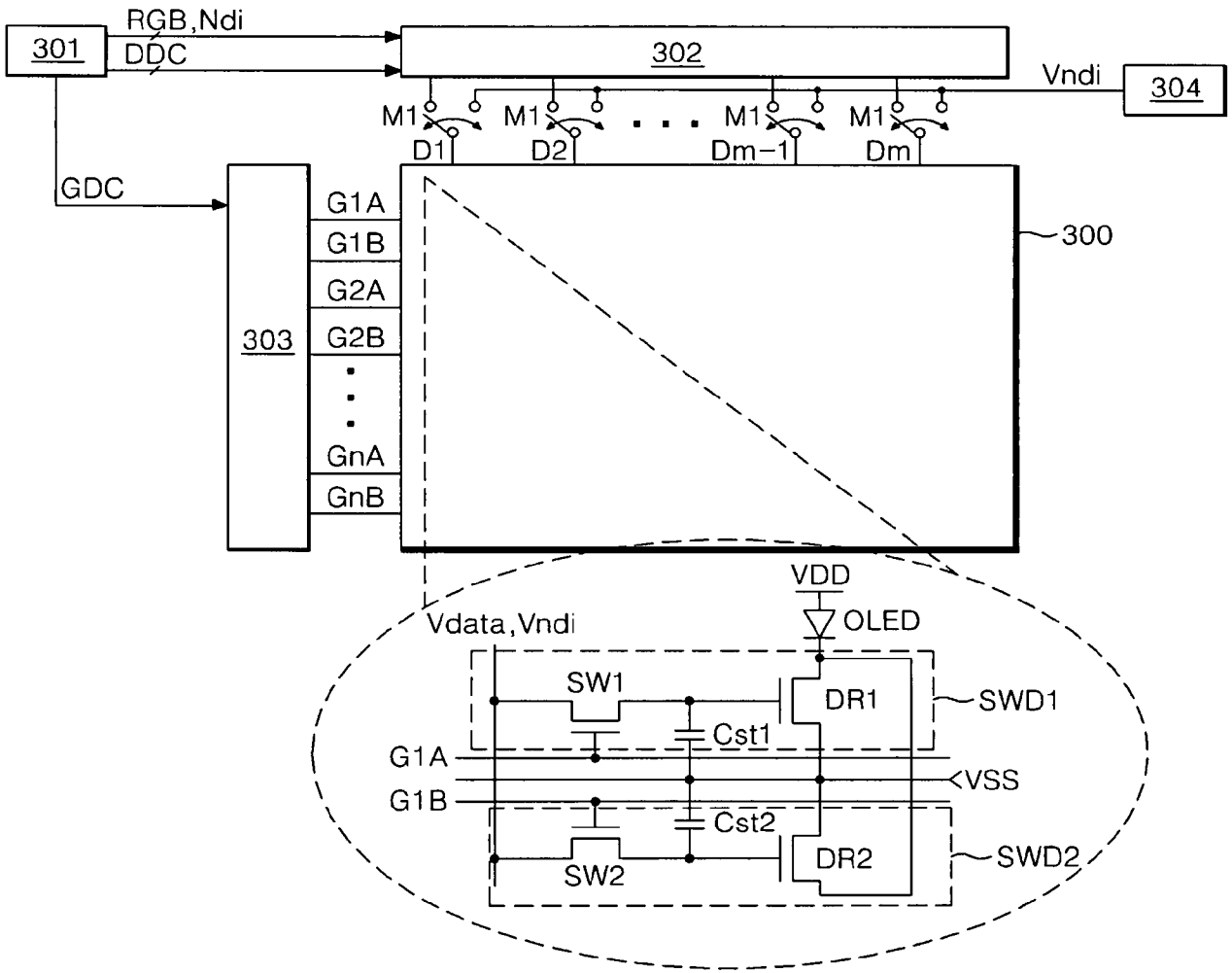
FIG. 30 is a block diagram showing an organic light emitting diode display device according to a fifth embodiment of the invention.

FIG. 30 shows an organic light emitting diode display device according to a fifth embodiment of the invention. Referring to FIG. 30, the organic light-emitting diode display device according to the fifth embodiment of the invention includes a display panel 300 provided with an m×n number of light emitting cells, a data driver 302 for converting digital video data RGB into a positive data voltage and supplying them to data lines D1 to Dm, a compensation data generator 304 for generating a negative compensation voltage Vndi, a switch array M1 formed between the data driver 302 and the display panel 300, a scan driver 303 for sequentially supplying scan pulses to gate lines G1A to GnB, and a timing controller 301 for controlling the drivers 302 and 303.

In the display panel 300, light emitting cells are formed at light emitting cell areas defined by crossings of the gate lines G1A to GnB and the data lines D1 to Dm. A high-level power supply voltage VDD and a low-level power supply voltage VSS are supplied to each of the light emitting cells of the display panel 300. The gate lines are paired to drive one pixel row. The gate line pairs G1A and G1B, G2A and G2Bm, . . . , GnA and GnB include two gate lines to which scan pulses are sequentially inputted.

Each of the light emitting cells is provided with first and second cell driving circuits SWD1 and SWD2 for alternately driving the organic light emitting diode OLED.

The data driver 302 converts digital video data RGB from the timing controller 301 into a positive data voltage to supply them to the data lines D1 to Dm. The data driver 302 does not include a circuit for generating a negative compensation voltage.

The compensation data generator 304 includes a negative voltage source to generate a compensation voltage Vndi and supply it to the switch array M1. Like the above-described embodiment, the compensation data generator 304 includes a look-up table and a negative voltage source so that it can select a negative compensation voltage Vdata corresponding to the sum of positive data voltages Vdata applied to the gate electrodes of the driving TFTs DR1 and DR2 during N frame periods and supply it to the switch array M1.

The switch array M1 includes an m number of switching devices formed between the data driver 302 and the display panel 300. Each of the switching devices M1 alternately connect an output terminal of the data driver 62 and an output terminal of the compensation data generator 304 to the data lines D1 to Dm under control of the timing controller 301. Hence, the switching devices M1 alternately supply a positive data voltage Vndi and a negative compensation voltage Vndi to the data lines D1 to Dm.

The scan driver 303 sequentially supplies scan pulses in response to a control signal GDC from the timing controller 301 to the gate lines G1A to GnB.

The timing controller 301 supplies digital video data RGB and digital compensation data Ndi to the data driver 302 and generates a timing control signal DDC and GDC controlling an operation timing of the scan driver 303 and the data driver 302 using, for example, a vertical/horizontal synchronizing signal and a clock signal.

Figure 31:
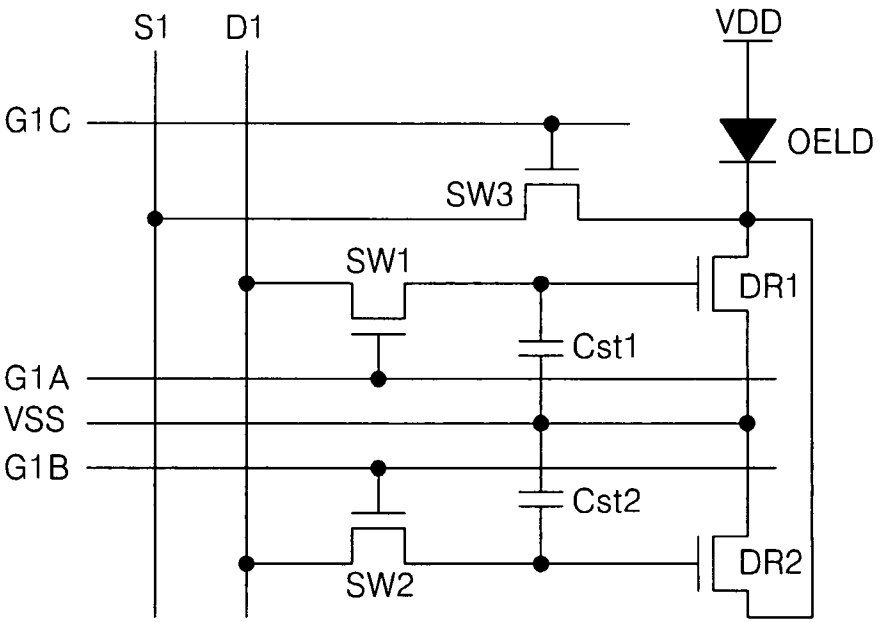
FIG. 31 is a circuit diagram showing a light emitting cell of an organic light emitting diode display device according to a sixth embodiment of the invention.
Figure 32:
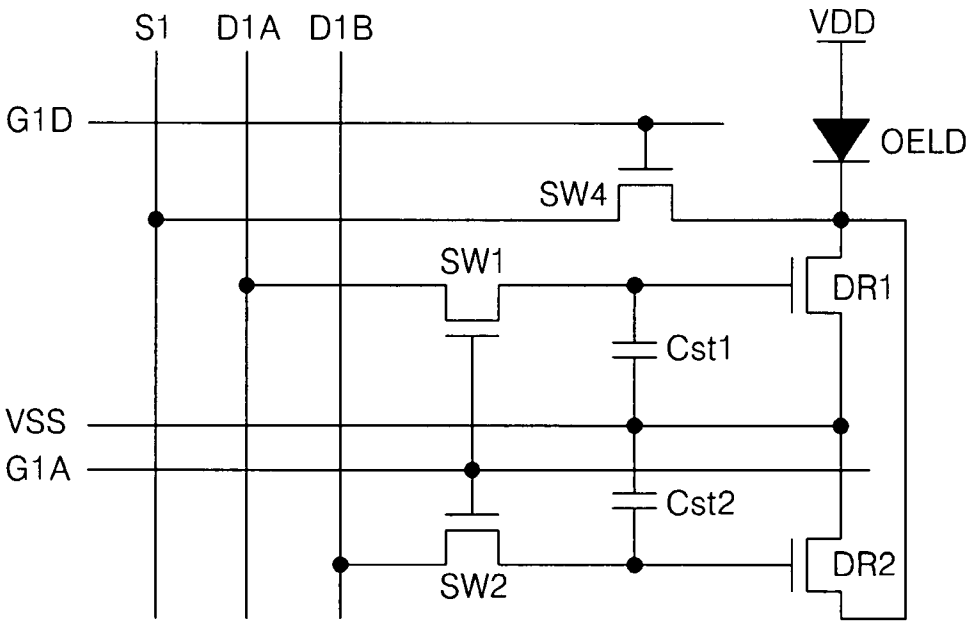
FIG. 32 is a circuit diagram showing a light emitting cell of an organic light emitting diode display device according to a seventh embodiment of the invention.

FIGS. 31 and 32 show other embodiments of the sensors. Referring to FIG. 31, each of light emitting cells of an organic light emitting diode display device according to a sixth embodiment of the invention includes first and second cell driving circuits for alternately driving an organic light emitting diode OLED in the same way as the foregoing embodiments and a sensor SW3 for switching a current path between a sensor line S1 and a cathode electrode of the organic light emitting diode OLED.

The sensor SW3 includes only one TFT. A source electrode of the sensor SW3 is connected to the sensor line S1, and a drain electrode thereof is connected to the cathode electrode of the organic light emitting diode OLED and drain electrodes of driving TFTs DR1 and DR2. A gate electrode of the sensor SW3 is connected to a 1C gate line G1.

The sensor SW3 supplies a voltage from the sensor line S1 to the cathode electrode of the organic light emitting diode OLED and the drain electrodes of the driving TFTs DR1 and DR2 in response to scan pulses from the 1C gate line G1C. At the same time, any one of first and second switching TFts SW1 and SW2 is turned on in response to scan pulses from 1A and 1B gate lines G1A and G1B. A reference voltage set to prevent the emission of the organic light emitting diode OLED and make current flow through the driving TFTs DR1 and DR2, for example, a high-level power voltage VDD is supplied to the sensor line S1 connected to the light emitting cell for sensing the current of the driving TFTs DR1 and DR2. Accordingly, in the light emitting cell whose sensor SW3 is turned on, the organic light emitting diode OLED is not emitted, and the current flowing through the driving TFTs DR1 and DR2 is supplied to the sensor line S1 via the sensor SW3. The current supplied to the sensor line S1 is converted into a voltage, and then converted into a digital signal and supplied to the look-up table for selecting compensation data Ndi.

Referring to FIG. 32, each of light emitting cells of an organic light emitting diode display device according to a seventh embodiment of the invention includes first and second cell driving circuits for alternately driving an organic light emitting diode OLED in the same way as the foregoing embodiments and a sensor SW4 for switching a current path between a sensor line S1 and a cathode electrode of the organic light emitting diode OLED.

In switching TFTs SW1 and SW2 of the first and second cell driving circuits, their gate electrodes are commonly connected to a 1A gate line G1A. The first switching TFT SW1 is turned on in response to scan pulses from the 1A gate line G1A to supply a positive data voltage Vdata or negative compensation voltage Vndi from the 1A data line G1A to a gate electrode of a first driving TFT DR1 and the cathode electrode of the organic light emitting diode OLED. The second switching TFT SW2 is turned on in response to scan pulses from the 1A gate line G1A to supply a positive data voltage Vdata or negative compensation voltage Vndi from the 1B data line D1B to a gate electrode of a second driving TFT DR1 and the cathode electrode of the organic light emitting diode OLED.

The sensor SW4 includes only one TFT. A source electrode of the sensor SW4 is connected to the sensor line S1, and a drain electrode thereof is connected to the cathode electrode of the organic light emitting diode OLED and drain electrodes of driving TFTs DR1 and DR2. A gate electrode of the sensor SW4 is connected to a ID gate line GD.

The sensor SW4 supplies a voltage from the sensor line S1 to the cathode electrode of the organic light emitting diode OLED and the drain electrodes of the driving TFTs DR1 and DR2 in response to scan pulses from the ID gate line G1D. At the same time, any one of first and second switching TFts SW1 and SW2 is turned on in response to scan pulses from 1A and 1B gate lines G1A and G1B. A reference voltage set to prevent the emission of the organic light emitting diode OLED and make current flow through the driving TFTs DR1 and DR2, for example, a high-level power voltage VDD is supplied to the sensor line S1 connected to the light emitting cell for sensing the current of the driving TFTs DR1 and DR2. Accordingly, in the light emitting cell whose sensor SW4 is turned on, the organic light emitting diode OLED does not emitted, and the current flowing through the driving TFTs DR1 and DR2 is supplied to the sensor line S1 via the sensor SW4. The current supplied to the sensor line S1 is converted into a voltage, and then converted into a digital signal and supplied to the look-up table for selecting compensation data Ndi.

Figure 33:
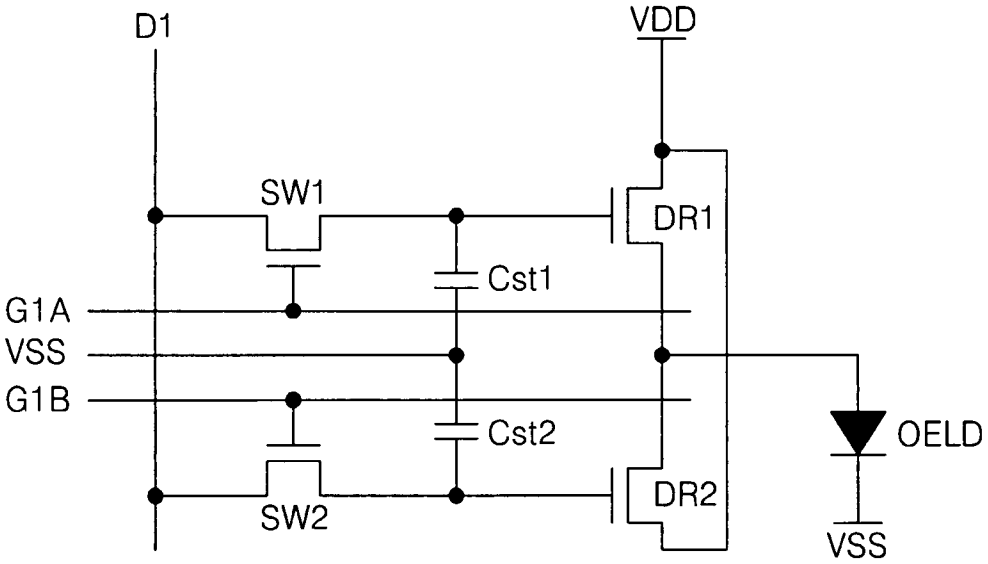
FIG. 33 is a circuit diagram showing a light emitting cell of an organic light emitting diode display device according to an eighth embodiment of the invention.

Unlike the foregoing embodiments, as shown in FIG. 33, the anode electrode of the organic light emitting diode OLED can be connected to the source electrodes of the driving TFTs DR1 and DR2, and the cathode electrode thereof may be connected to a low-level voltage source VSS.

Although the driving TFTs have been described as implemented by an n-channel MOS-FET, the driving TFTs may also be implemented as a p-channel MOS-FET. In this case, a data voltage is applied as a negative voltage to the gate electrodes of the driving TFTs, and a compensation voltage is applied as a positive voltage to the gate electrodes of the driving TFTs.

As described above in detail, in the organic light emitting diode display device and driving method thereof according to the embodiments of the invention, first and second cell driving circuits for alternately driving the organic light emitting diode are formed in each of light emitting cells, and hence a variation in the threshold voltage of the driving TFTs can be periodically maintained while maintaining the light emission of the organic light emitting diode by forming.

It will be apparent to those skilled in the art that various modifications and variations can be made in embodiments of the invention without departing from the spirit or scope of the invention. Thus, it is intended that embodiments of the invention cover the modifications and variations of this invention provided they come within the scope of the appended claims and their equivalents.

What is claimed is:

1. An organic light emitting diode display device, comprising:

a display panel including a plurality of data lines, a plurality of gate line pairs crossing the data lines, and a plurality of light emitting cells which include an organic light emitting diode device, first and second cell driving circuits for alternately driving the organic light emitting diode device;

a data voltage generator supplying a data voltage of a first polarity to the data lines;

a compensation voltage generator supplying a compensation voltage of a second polarity to the data lines; and a scan driver for sequentially supplying scan pulses to the gate line pairs, wherein the first cell driving circuit includes a first driving device, and the second cell driving circuit includes a second driving device, wherein first electrodes of the first and second driving devices commonly connected to one electrode of the organic light emitting diode device, wherein the first and second cell driving circuits are alternately supplied with the data voltage and the compensation voltage in response to the scan pulses to alternately driven the organic light emitting diode, wherein the scan driver supplies a first scan pulse synchronized with the compensation voltage to first gate lines included in the gate line pairs and supplies a second scan pulse synchronized with the data voltage to second gate lines included in the gate line pairs within a first period, and then supplies the first scan pulse synchronized with the data voltage to first gate lines and supplies the second scan pulse synchronized with the compensation voltage to second gate lines within a second period, and wherein the first period and the second period include more than one frame period, respectively.

2. The organic light emitting diode display device according to claim 1, wherein the first cell driving circuit has:

a first switching device for connecting the data lines to a first node in response to scan pulses from the first gate lines included in the gate line pairs;

a first driving device whose gate electrode is connected to the first node to drive the organic light emitting diode during the first emission period; and a first storage capacitor connected between the first node and a low-level voltage source.

3. The organic light emitting diode display device according to claim 2, wherein the second cell driving circuit has:

a second switching device for connecting the data lines to a second node in response to scan pulses from the second gate lines included in the gate line pairs;

a second driving device whose gate electrode is connected to the second node to drive the organic light emitting diode during the second emission period; and a second storage capacitor connected between the second node and a low-level voltage source.

4. The organic light emitting diode display device according to claim 3, wherein the organic light emitting diode display device is further provided with a sensor for sensing current flowing through the driving devices, and the compensation voltage generator selects the compensation voltage based on the current sensed by the sensor.

5. The organic light emitting diode display device according to claim 1, wherein the voltage level of the compensation voltage differs according to a sum of the data voltages supplied to the cell driving circuits during more than one frame period.

6. A driving method of an organic light emitting diode display device, the organic light emitting diode display device comprising a display panel including a plurality of data lines, a plurality of gate line pairs crossing the data lines, and a plurality of light emitting cells which include an organic light emitting diode device, first and second cell driving circuits for alternately driving the organic light emitting diode device, comprising:

supplying a data voltage of a first polarity to the data lines;

supplying a compensation voltage of a second polarity to the data lines;

sequentially supplying scan pulses to the gate line pairs;

alternately supplying the data voltage and the compensation voltage to the first and second driving circuits in accordance with the scan pulses to drive the organic light emitting diode, wherein the first cell driving circuit includes a first driving device, and the second cell driving circuit includes a second driving device, wherein first electrodes of the first and second driving devices commonly connected to a one electrode of the organic light emitting diode device, and wherein sequentially supplying scan pulses to the gate line pairs comprises:

supplying a first scan pulse synchronized with the compensation voltage to first gate lines included in the gate line pairs and supplies a second scan pulse synchronized with the data voltage to second gate lines included in the gate line pairs within a first period; and supplying the first scan pulse synchronized with the data voltage to first gate lines and supplies the second scan pulse synchronized with the compensation voltage to second gate lines within a second period, wherein the first period and the second period include more than one frame period, respectively.

7. The method according to claim 6, wherein the voltage level of the compensation voltage differs according to a sum of the data voltages supplied to the cell driving circuits during more than one frame period.

8. The method according to claim 6, further comprising:

sensing current flowing through the driving the driving devices, selecting the compensation voltage based on the current sensed by the sensor.

* * * * *